US012656052B2

(12) United States Patent
Phy et al.

(10) Patent No.: US 12,656,052 B2
(45) Date of Patent: Jun. 16, 2026

(54) CANTIVLEVER SHELVING ASSEMBLY

(71) Applicant: Nashville Wire Products Manufacturing Company, LLC, Nashville, TN (US)

(72) Inventors: John Nicholas Phy, Pegram, TN (US); Jammie Todd Allbert, White Bluff, TN (US); Dorcas Jane Engelman, Primm Springs, TN (US); Phillip Kent Rollins, Nashville, TN (US); William Jacob Johnson, Spring Hill, TN (US)

(73) Assignee: Nashville Wire Products Manufacturing Company, LLC, Nashville, TN (US)

( * ) Notice: Subject to any disclaimer, the term of this patent is extended or adjusted under 35 U.S.C. 154(b) by 195 days.

(21) Appl. No.: 18/392,351

(22) Filed: Dec. 21, 2023

(65) Prior Publication Data

US 2025/0207846 A1 Jun. 26, 2025

(51) Int. Cl.
*A47B 96/06* (2006.01)
*F25D 25/02* (2006.01)

(52) U.S. Cl.
CPC ..... *F25D 25/02* (2013.01); *A47B 96/061* (2013.01)

(58) Field of Classification Search
CPC ... A47B 96/061; A47B 96/027; A47B 47/022; A47B 57/30; A47B 57/34; A47B 57/06; A47B 96/028; A47B 57/42; A47B 96/1458; A47B 96/1441; A47B 57/16; A47B 96/06; A47B 96/024; A47B 57/045; A47B 96/14; A47B 47/028; A47F 5/103; A47F 5/01; A47F 5/0043; A47F 5/0018; F25D 25/02
See application file for complete search history.

(56) References Cited

U.S. PATENT DOCUMENTS 2,875,904 A * 3/1959 Gingher ..... A47B 61/00 108/186
3,089,675 A * 5/1963 Lozier ..... A47B 57/425 248/242
3,093,094 A * 6/1963 Oztekin ..... A47B 57/045 248/242
3,765,344 A * 10/1973 Ferdinand ..... A47B 45/00 108/182
3,871,144 A * 3/1975 Rudin ..... A47B 57/42 52/36.5
3,948,581 A * 4/1976 Helman ..... A47B 47/05 312/238
3,993,002 A * 11/1976 Stroh ..... A47F 5/13 211/90.03

(Continued)

*Primary Examiner* — Hiwot E Tefera
(74) *Attorney, Agent, or Firm* — Andrew T. Ball; Lucian Wayne Beavers; Patterson Intellectual Property Law, PC

(57) ABSTRACT

Disclosed herein are example shelving assemblies having cantilevered shelves. A shelving assembly can include a base having a front and a rear, as well as at least two columns extending upward from the rear of the base. The shelving assembly can also include an upper cross-support beam connecting an upper end portion of the two columns. A plurality of cantilevered support brackets can extend forwards from the columns and can support one or more shelves. The shelving assemblies can be loaded from the rear of the assemblies through a span between the columns Also disclosed herein are enclosures, such as coolers, which include a cantilevered shelving assembly according to the present disclosure.

20 Claims, 15 Drawing Sheets

(56) References Cited

U.S. PATENT DOCUMENTS 4,108,085 A * 8/1978 Shepherd ..... A47F 5/103 108/193
4,932,539 A * 6/1990 Abinanti ..... A47B 96/1458 211/205
5,022,541 A * 6/1991 White ..... A47F 5/103 211/186
5,074,422 A * 12/1991 Holtz ..... A47B 57/10 211/187
5,607,070 A * 3/1997 Hellyer ..... A47F 5/0846 211/187
8,499,942 B1 * 8/2013 Coretti, Jr. ..... A47B 96/021 211/181.1
10,021,972 B1 * 7/2018 Robinson ..... A47B 57/30
10,159,339 B1 * 12/2018 Powell ..... A47B 57/485
2005/0109720 A1 * 5/2005 Marchetta ..... A47B 96/1458 211/90.03
2005/0145147 A1 * 7/2005 Costa ..... A47B 96/028 211/90.03
2006/0049726 A1 * 3/2006 Hayase ..... A47F 3/0408 312/128
2006/0076304 A1 * 4/2006 Kainuma ..... A47F 3/00 211/187
2006/0213403 A1 * 9/2006 Witt ..... A47B 81/002 108/180
2007/0045210 A1 * 3/2007 Richardson ..... A47B 57/42 211/187
2007/0262685 A1 * 11/2007 Randolph ..... A47B 57/40 312/223.5
2007/0267375 A1 * 11/2007 Battaglia, ..... A47B 47/03 211/189
2010/0077781 A1 * 4/2010 Decker ..... F25D 25/02 62/251
2010/0252521 A1 * 10/2010 Chen ..... A47B 57/42 211/208
2011/0309043 A1 * 12/2011 Kaiser ..... A47F 5/005 211/59.2
2012/0037583 A1 * 2/2012 Wise ..... A47B 57/20 211/150
2013/0233818 A1 * 9/2013 Gupta ..... A47B 47/022 248/250
2014/0259831 A1 * 9/2014 Denby ..... A47F 5/10 211/208
2014/0263125 A1 * 9/2014 Gonzalez ..... A47B 96/06 248/250
2014/0374555 A1 * 12/2014 Sukman ..... A47B 96/028 248/222.14
2016/0220022 A1 * 8/2016 Fu ..... A47B 57/34
2016/0374466 A1 * 12/2016 Miller, Jr. ..... A47F 5/103 248/201
2020/0054125 A1 * 2/2020 Robinson ..... A47B 96/028
2020/0069051 A1 * 3/2020 Knutson ..... A47B 96/027
2020/0143714 A1 * 5/2020 Gonzalez ..... G09F 3/204
2023/0012306 A1 * 1/2023 Fundberg ..... A47B 47/022
2024/0285073 A1 * 8/2024 Shehata ..... A47B 57/402

* cited by examiner

CANTIVLEVER SHELVING ASSEMBLY

FIELD OF THE INVENTION

The present application relates to cantilevered shelving assemblies, and enclosures, particularly coolers, enclosing the same.

BACKGROUND

Refrigerated shelfing is an important component of any supermarket, convenience store, or other retail location that sells perishable and/or cooled items, including frozen foods, beverages, meats, dairy products, and the like. In many cases, refrigerated shelving units include a cooler that can be adjacent to and stocked from a rear-facing storeroom to which the customer has no access, and accordingly stocking and customer selection occur at opposite ends of the shelving unit.

However, most such refrigerated units include shelving assemblies with frontal posts. Such assemblies are wasteful of space, particularly inside refrigerated coolers. Additionally, the inclusion of frontal posts may interrupt or obstruct customer access to goods stored on the shelves. Accordingly, there is a need for space-efficient shelving that is easily stocked from a storeroom, and which is easily accessible to customers.

SUMMARY

Disclosed herein are shelving assemblies comprising cantilevered shelves. The shelving assemblies have shelves accessible for stocking from the rear and present an uninterrupted front edge to a shopper. Also disclosed herein are enclosures, particularly refrigerated enclosures, that include a shelving unit according to the examples disclosed herein. These enclosures can include one or more front-opening doors that expose an uninterrupted front edge of the shelving assembly, and may be accessible from the rear, to facilitate stocking of the shelving assembly.

Certain examples concern a shelving assembly, comprising a base having a front and a rear. The shelving assembly also comprises at least two columns extending upward from the rear of the base, an upper cross-support beam connecting an upper end portion of the two columns, and a plurality of cantilevered support brackets, each bracket being attached to a respective one of the columns at one of a plurality of selectable positions along a height of the respective one of the columns, and each bracket extending forward over the base. The shelving assembly also comprises at least one shelf supported between two laterally adjacent ones of the support brackets. A span between the two columns is open so that shelf can be loaded from the rear.

Certain examples concern a cooler comprising a cooler frame having a front portion and a back portion and a pair of doors positioned at the front portion of the cooler frame and having opposite vertical edges pivotally mounted to the cooler frame so that the doors open away from each other and so that free vertical edges of the doors join to form a door closure seam when the doors are closed. The cooler also has a cantilevered shelving assembly located inside the cooler frame and including a plurality of cantilevered shelves extending forward toward the doors, each shelf having a continuous forward shelf edge extending across the opening between the doors, so that when the doors are open the forward shelf edge of each shelf is accessible across an entire width of the opening. The cooler frame does not include any vertical frame member directly behind the door closure seam, so that when the doors are open there is no vertical frame member blocking an opening between the doors.

Certain examples concern a shelving unit, comprising a plurality of vertically extending columns spaced laterally apart from one another, each column of the plurality of vertically extending columns having a top end portion and a bottom end portion. The shelving unit also comprises an upper lateral support beam extending between the respective top end portions of two adjacent columns and a lower lateral support beam between the respective bottom end portions of two adjacent columns. The shelving unit also comprises a base extending forward from the bottom end portions of each column of the plurality of vertically extending columns and having a front end portion and a back end portion, wherein the front end portion of the base is not attached to any vertically extending column. The shelving unit also comprises a plurality of shelving brackets, each shelving bracket of the plurality of shelving brackets removably attached no more than one corresponding column of the plurality of column and one or more wire shelves extending between and supported by one or more corresponding pairs of adjacent brackets, wherein the one or more wire shelves are vertically adjustable by adjusting a position of a corresponding pair of adjacent brackets. The vertically extending columns are separated by an open span that allows the one or more wire shelves to be loaded by introducing goods through the open span between the vertically extending columns.

Numerous objects, features and advantages of the embodiments set forth herein will be readily apparent to those skilled in the art upon reading of the following disclosure when taken in conjunction with the accompanying drawings.

BRIEF DESCRIPTION OF THE DRAWINGS

A full and enabling disclosure of the aspects of the invention, directed to one of ordinary skill in the art, is set forth in the specification, which makes reference to the appended figures, in which.

DETAILED DESCRIPTION

Figure 1:
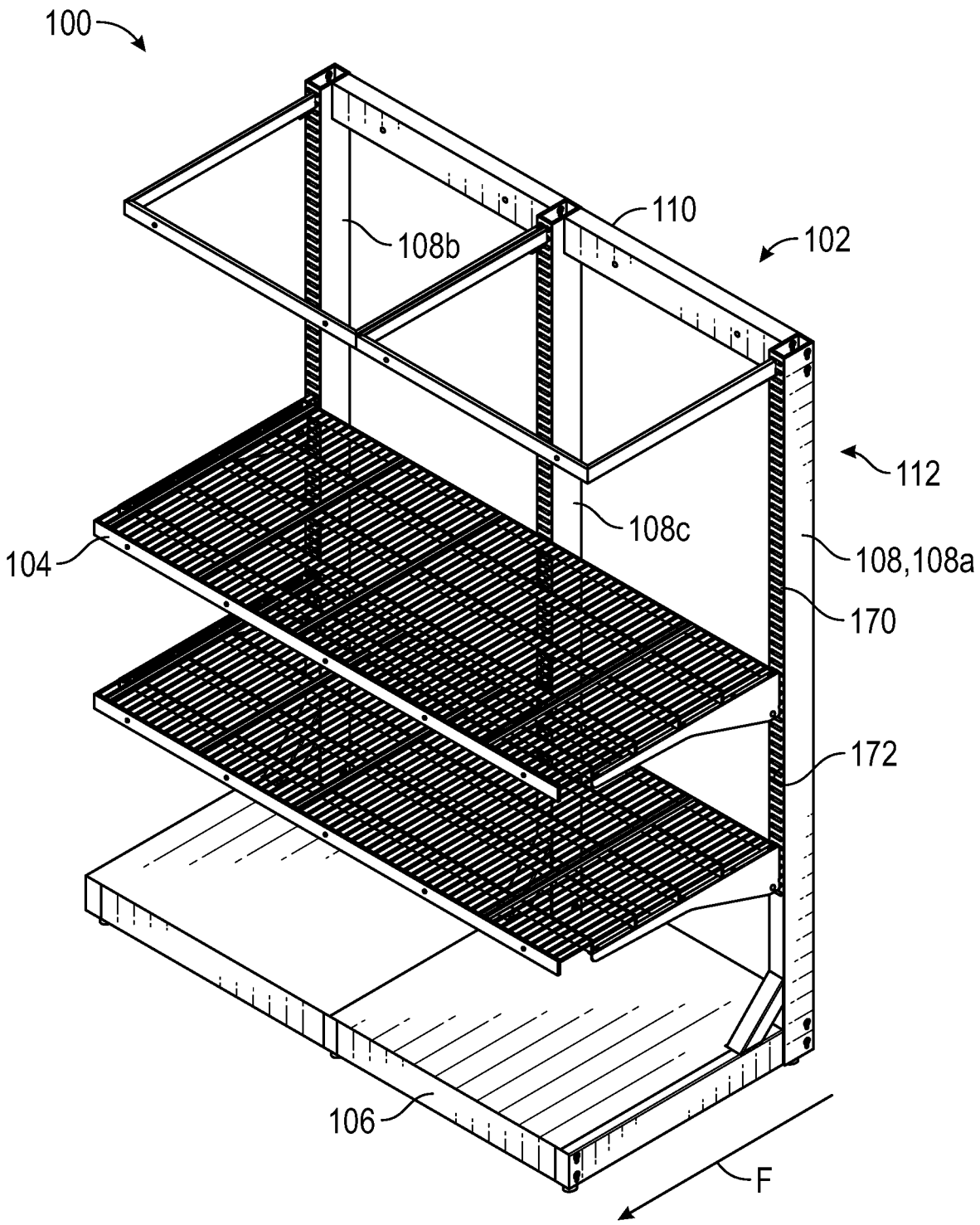
FIG. 1 is a perspective view of a shelving assembly according to one aspect of the present disclosure.

Reference will now be made in detail to aspects of the disclosure, one or more examples of which are illustrated in the drawings. Each example is provided by way of explanation, not limitation, of the disclosure. It will be apparent to those skilled in the art that various modifications and variations can be made to the examples presented in the present disclosure without departing from the scope or spirit thereof. For instance, features disclosed as part of one example can be used in conjunction with features of another example to yield a still further example. Thus, it is intended that the present disclosure covers such modifications and variations as come within the scope of the claims and their equivalents.

General Terms

The word "exemplary" is used herein to mean "serving as an example, instance, or illustration." Any implementation described herein as "exemplary" is not necessarily to be construed as preferred or advantageous over other implementations.

As used herein, the terms "first," "second," "third," and so on may be used interchangeably to distinguish one component from another and are not intended to signify location or importance of the individual components.

The terms "coupled," "fixed," "attached to," and the like refer both to direct coupling, fixing, or attaching, as well as indirect coupling, fixing, or attaching through one or more intermediate components or features, unless otherwise specified herein.

The singular forms "a," "an," and "the" include plural references, unless the context clearly indicates otherwise.

Unless otherwise indicated, all numbers expressing dimensions of components, percentages, temperatures, weights, and so forth, as used in the specification or claims are to be understood as being modified by the term "about." Accordingly, unless otherwise indicated, implicitly or explicitly, the numerical parameters set forth are approximations that can depend on ordinary manufacturing tolerances, minor design variations, or limits of the measuring technique used. When directly and explicitly distinguishing embodiments from discussed prior art, the embodiment numbers are not approximates unless the word "about" is recited. Furthermore, not all alternatives recited herein are equivalents.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 1, 2, 4, 10, 15, or 20 percent margin.

Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

Introduction to the Disclosed Technology

Disclosed herein are examples of modular and adjustable shelving assemblies, and particularly shelving assemblies suitable for use in refrigerated coolers. Generally, the shelving assemblies disclosed herein include one or more forwardly extending cantilevered shelves that are accessible from the rear of the shelf to facilitate stocking, and which present a continuous or uninterrupted shelving front positioned towards the front of the assembly.

Advantageously, this combination of features omits front-end posts, which saves space within an enclosure such as a cooler and avoids blocking customer access to shelved goods. Furthermore, because the shelves disclosed herein and enclosures containing the shelves disclosed herein can be stocked from the back, they may advantageously be stocked from, for example, a storeroom located behind the enclosure (for example, the cooler), and hidden from customers.

Aspects of the Disclosed Technology

FIG. 1 shows a shelving assembly 100, with cantilevered shelves according to one aspect of the present disclosure which is accessible from the rear of the assembly. The shelving assembly 100 includes one or more frame units 102 and one or more cantilevered shelves 104 attached to the frame units 102 and extending in a frontal direction, F.

According to some aspects of the disclosure, the frame unit 102 includes a base section 106, two or more upright columns 108, and a cross-support beam 110. As shown in FIG. 1, the upright columns 108 extend vertically (that is, upward) from the base section 106, with an open span separating adjacent upright columns 108. The cross-support beams 110 extend between a top end portion 112 of each of two adjacent upright columns 108, thereby interconnecting the upright columns 108.

Figure 2B:
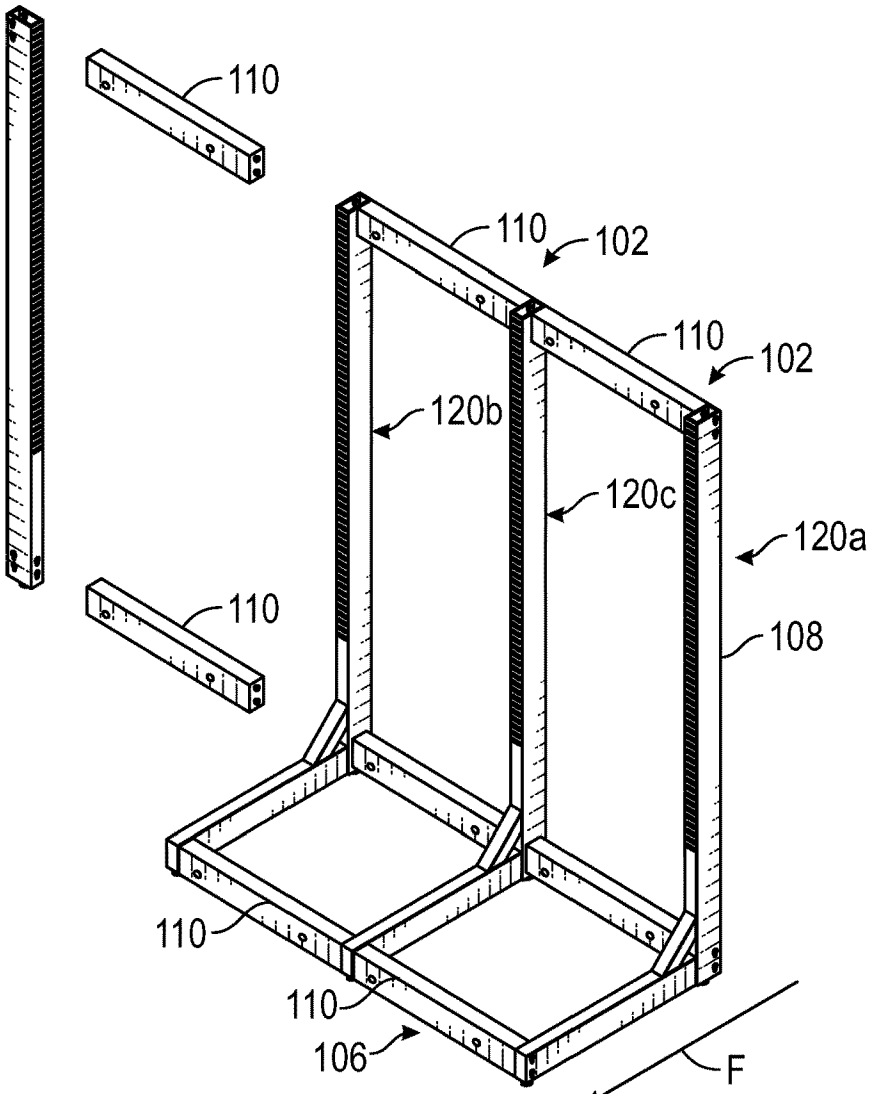
FIG. 2B is a perspective view of adjacent frame units of the shelving assembly of FIG. 1, and additional components for another frame unit.
Figure 2A:
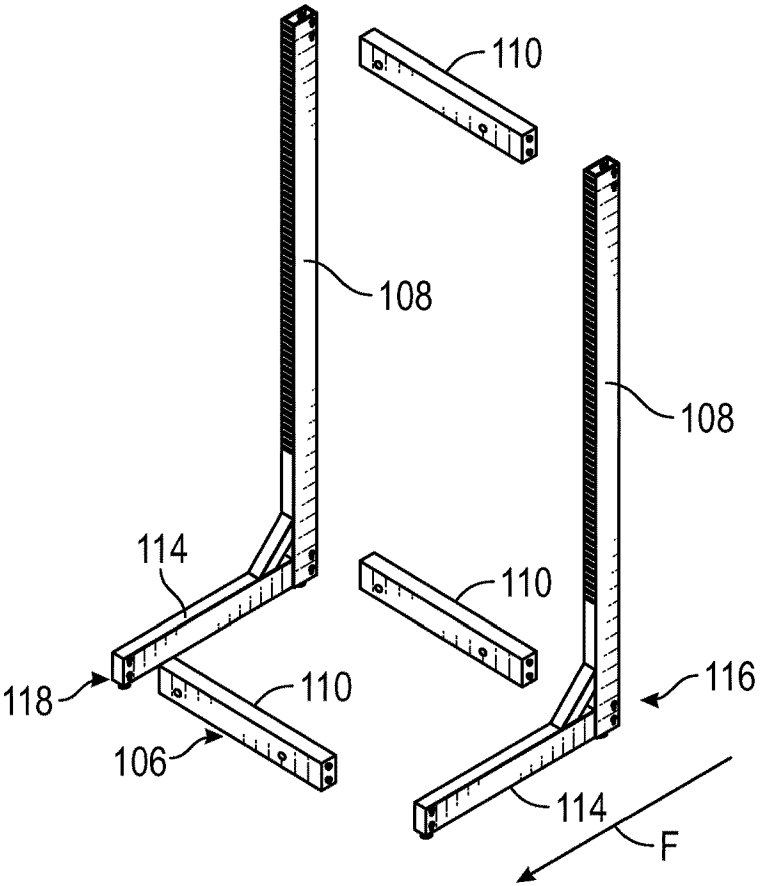
FIG. 2A is an exploded perspective view of a frame unit of the shelving assembly of FIG. 1.

Turning now to FIG. 2A, the base section 106 can be formed, in some examples, from a pair of adjoining base members 114. The base members 114 can extend from a bottom end portion 116 of each of the upright columns 108 in the frontal direction F. The base members 114 can further be connected at a front end portion 118 of each of the base members 114 by a cross-support beam 110 to form a substantially square base section 106. While the base members 114 shown in FIG. 2A are substantially straight and parallel to form a substantially square base section 106, it will be appreciated that the base may be any other appropriate geometry, and the base members 114 can be of different shape, and may be disposed at an angle relative to one another.

Figure 3A:
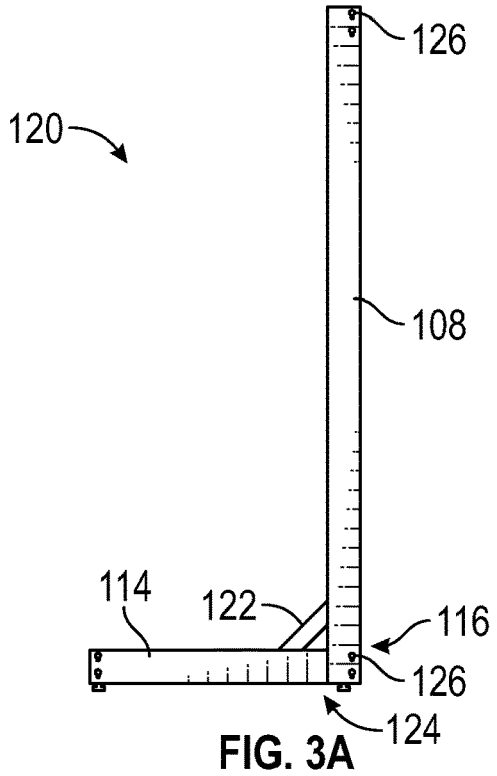
FIG. 3A is a side view of an upright column component of the frame unit of FIG. 2A.
Figure 3B:
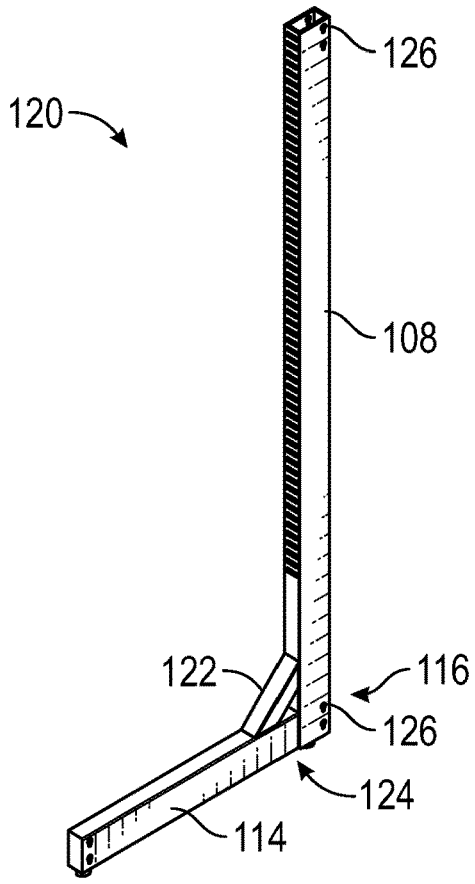
FIG. 3B is a perspective view of the component shown in FIG. 3A.

According to some aspects of the disclosure, the upright columns 108 and the base members 114 can be an integrally formed piece (that is, the upright column 108 and the base member 114 can be permanently or fixedly joined), as is shown in FIGS. 3A and 3B, to form an L-shaped frame member 120. However, while FIGS. 3A and 3B show an L-shaped frame member integrally formed from a fixedly joined base member 114 and upright column 108, it will be appreciated that these components do not need to be integrally formed, and that, in some examples, they may instead be separately formed, and releasably joined, for example by using one of the mechanisms disclosed herein, such as the keyhole mount disclosed below.

In such examples, especially those in which the L-shaped frame member 120 is integrally formed from the upright column 108 and the base member 114, a diagonal bracing member 122 can extend from the bottom end portion 116 of the upright column 108 to a rear end portion 124 of the base member 114. The inclusion of the diagonal bracing member 122 between the upright column 108 and the base member 114 can improve the rigidity of the L-shaped frame member 120, particularly along the axis extending from the front end of the frame units 102 to the back end of the frame units 102.

Returning to FIG. 2A, the frame units 102 can, in some examples, further include another cross-support beam 110, extending between the bottom end portion 116 each of the adjacent upright columns 108. This additional cross-support beam 110 can further provide structural stability to the base section 106 and the upright columns 108.

Figure 4A:
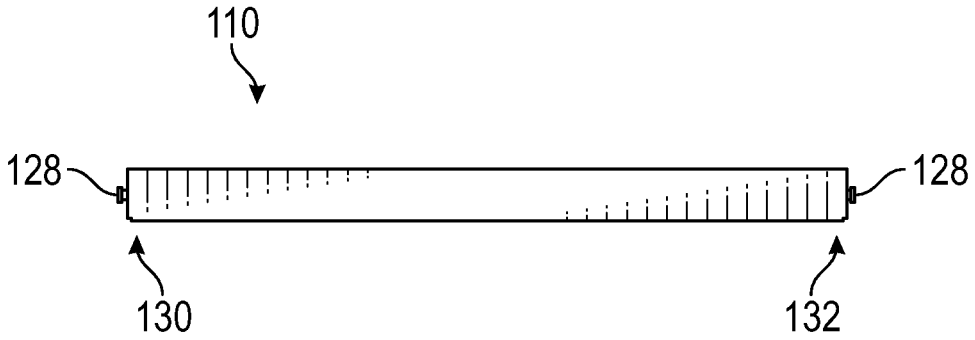
FIG. 4A is a top view of a cross-support beam of the frame unit of FIG. 2A.
Figure 4B:
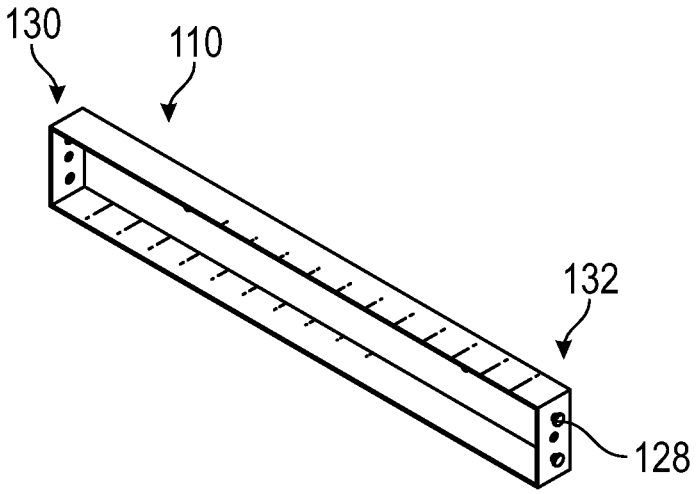
FIG. 4B is a perspective view of the cross-support beam shown in FIG. 4A.

According to some aspects of the disclosure, L-shaped frame members 120 and the cross-support beams 110 can be joined by using a keyhole mount consisting of a shaped orifice 126 and a corresponding peg 128 which is received by the shaped orifice 126. For example, as shown in FIGS. 3A and 3B, the L-shaped frame member 120 can include a pair of shaped orifices 126 at each of the top end portion 112 and the bottom end portion 116, and a pair of shaped orifices 126 at the front end portion 118 of the base member 114. Likewise, as shown in FIGS. 4A and 4B, the cross-support beams 110 can include a pair of pegs 128 positioned at each of a first lateral end 130 and a second lateral end 132.

Figure 5:
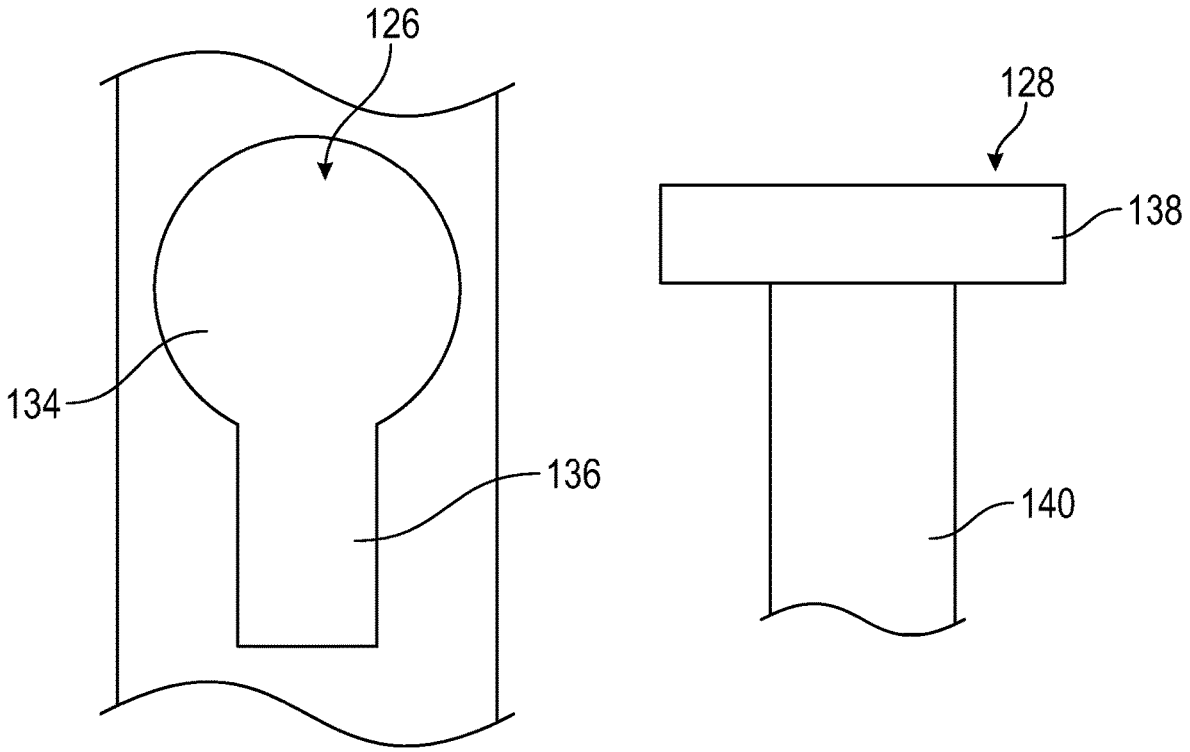
FIG. 5 is a schematic showing the slot and peg of a keyhole attachment feature, as shown in FIG. 2A.

As shown in FIG. 5, the shaped orifice 126 includes a comparatively wide aperture 134 and a comparatively narrow channel 136 extending from the aperture 134. Likewise, the peg 128 has a comparatively wide head portion 138 and a comparatively narrow shaft portion 140. The aperture 134 sized such that the head portion 138 can pass into the aperture until the shaft portion 140 is aligned with the channel 136. The upright column 108 or the base member 114 and the cross-support beam 110 can then be joined by moving the cross-support beam 110 (and accordingly the peg 128) such that the shaft portion 140 enters into the channel 136. Because the channel 136 is too narrow to admit the entry or withdrawal of the head portion 138 of the peg 128, the cross-support beam 110 will thereby be releasably connected to the upright column 108 or to the base member 114. By releasably connecting each end of the cross-support beam 110 to an upright column 108, two adjacent columns 108 can be secured to each other. Similarly, by releasably connecting each end of the cross-support beam 110 to a base member 114, two adjacent base members 114 can be secured to each other. In this way, the frame units 102 can be assembled from two L-shaped frame members 120 conjoined by one or more support beams 110 extending between the two L-shaped frame members 120.

Figure 6:
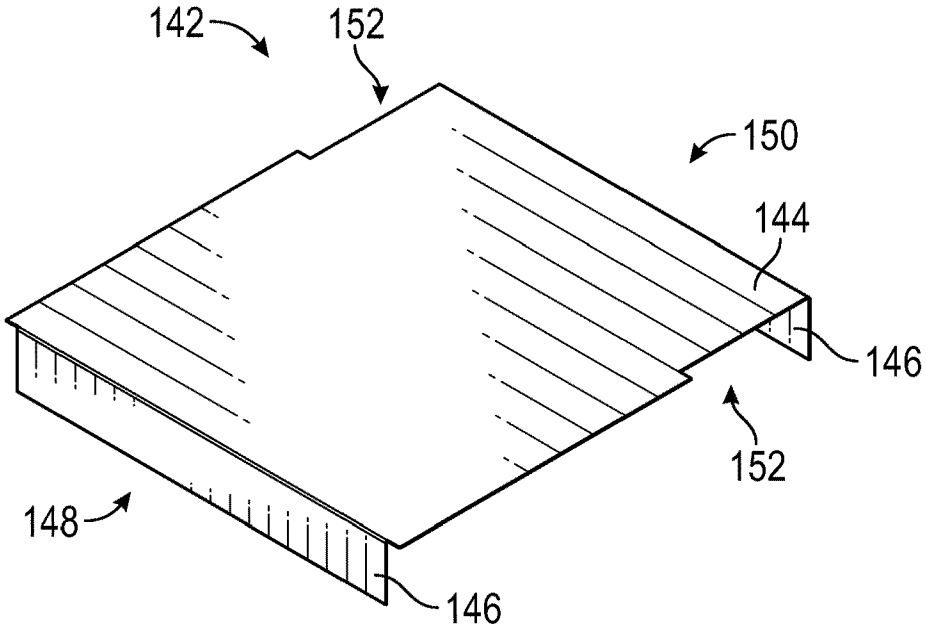
FIG. 6 is a perspective view of a sheet covering for a base section of the shelving assembly of FIG. 1.

According to some aspects of the present disclosure, the base section 106 can also include a cover 142, illustrated in FIG. 6. The cover 142 can include a horizontal sheet 144 a vertical sheet 146 depending from a front end portion 148 of the horizontal sheet 144 and another vertical sheet 146 depending from a rear end portion 150 of the horizontal sheet 144. The cover 142 can be sized such that, when the cover 142 is placed over the cross-support beams 110 connecting an adjacent pair of L-shaped frame members 120, the vertical sheet 146 at the front end portion 148 and the vertical sheet 146 at the rear end portion 150 fit over the cross-support beams 110. In this way, the cover 142 provides a solid top surface for the base section 106 and can conceal a portion of a floor that is beneath the frame units 102.

According to some aspects of the present disclosure, the cover 142 can be removable from the base members 114 and the cross-support beams 110 that define the area of the base section 106. In other aspects of the present disclosure, the cover 142 can be fixedly attached to the base members 114 and the cross-support beams 110 that define the area of the base section 106. The cover 142 can, according to the needs of a particular application which will be appreciated by those skilled in the art, be made of sheet metal, plastic, or any other suitable material.

In some examples, such as that shown in FIG. 6, the cover 142 can further include one or more notches 152 that correspond to the upright columns 108 of the frame units 102, allowing the 142 to additionally cover the base members 114 of the frame units 102, thereby covering the entire top surface of the base section 106 with the cover 142.

Returning to FIG. 2B, according to some aspects of the present disclosure, the shelving assembly 100 may include multiple frame units 102 positioned side by side to extend the length of the shelving assembly 100 in a lateral direction L. In such examples, any L-shaped frame member 120 may be adjacent to more than one other L-shaped frame member 120, such as shown in FIG. 2B, which depicts a first L-shaped frame member 120*a* and a second L-shaped frame member 120*b* disposed on either side of a third L-shaped frame member 120*c*. Thus, the third L-shaped frame member 120*c* can be part of two adjacent frame units 102 simultaneously. It will be appreciated that in such circumstances, any such L-shaped frame member 120 may include suitable features to facilitate this, such as an additional set of shaped orifices 126 laterally opposite to the shaped orifices 126 described above and shown in FIG. 2A. The additional set of shaped orifices 126 can, in such examples, receive pegs 128 of one or more additional cross-support beams 110 positioned on the opposite side of the L-shaped frame member 120 from the cross-support beams previously described in relation to FIG. 2A, as shown in FIG. 2B.

Figure 8A:
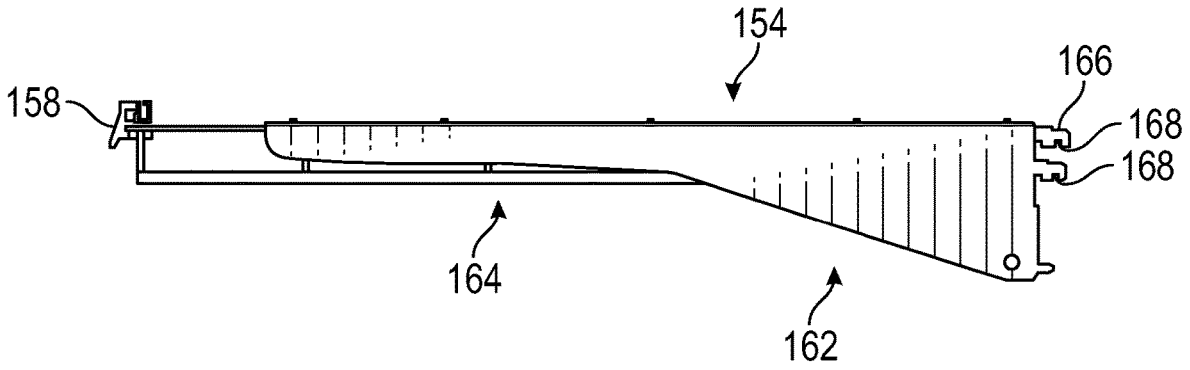
FIG. 8A is a cantilevered shelf supported by a bracket according to one aspect of the present disclosure.
Figure 8B:
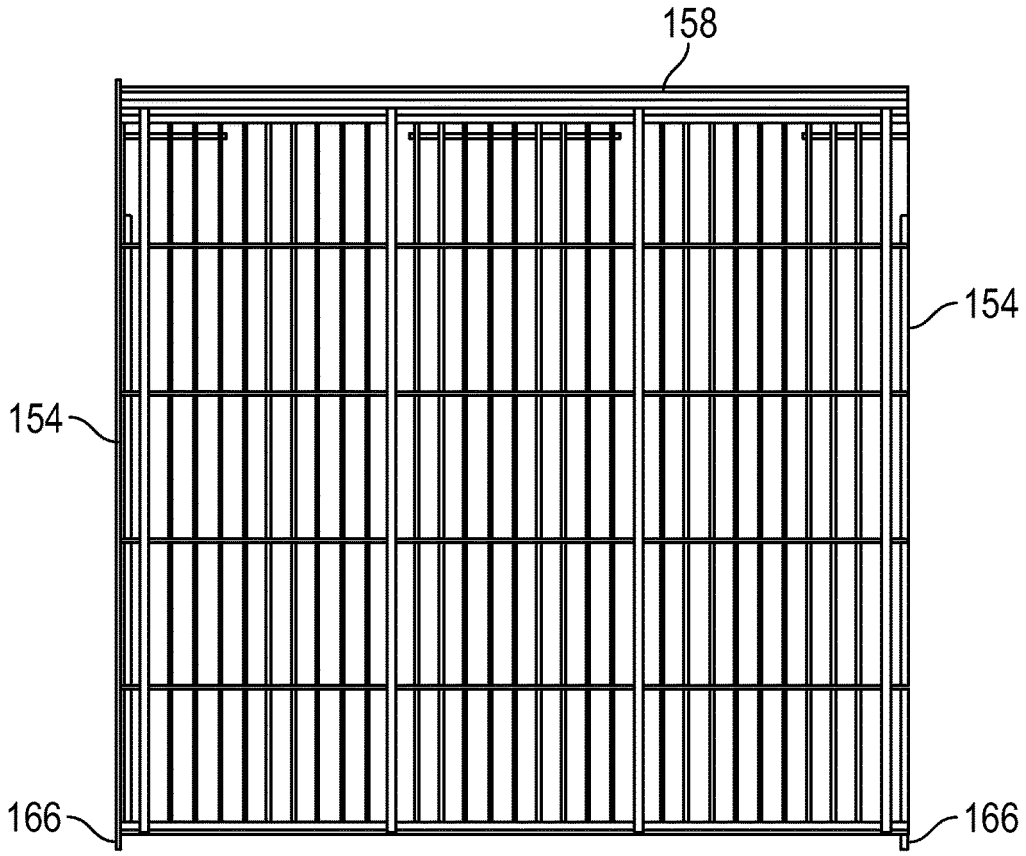
FIG. 8B is a shelving unit supported by the cantilevered bracket of FIG. 8A.
Figure 8C:
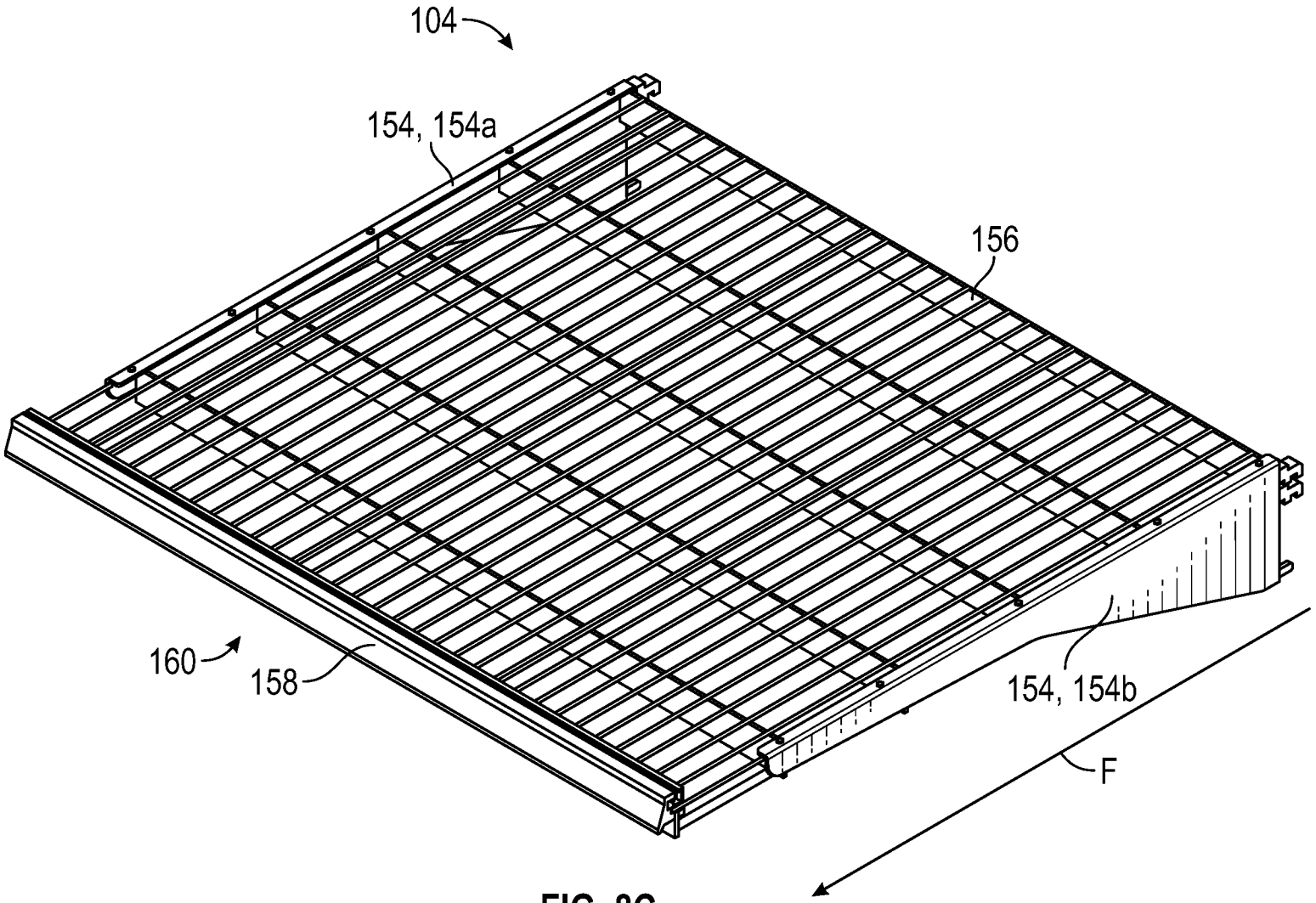
FIG. 8C is a perspective view of a cantilevered shelf including the bracket of FIG. 8A.

The frame units 102 described herein can support the one or more cantilevered shelves 104 according to one aspect of the present disclosure, which is illustrated in greater detail in FIGS. 8A through 8C. As shown in FIG. 8C, the cantilevered shelf 104 comprises a pair of laterally spaced-apart cantilever brackets 154. A platform 156 (for example, the wire shelf shown in FIGS. 8B and 8C) extends between the pair cantilever brackets 154 to form a shelving surface. In some examples, the cantilevered shelf 104 additionally includes a lip 158 positioned along a forward shelf edge 160 of the cantilevered shelf 104, which may advantageously prevent goods from slipping off the forward shelf edge 160 of the cantilevered shelf 104. While the platform 156 shown in FIG. 8C is a wire shelf, it will be appreciated that the platform 156 can, in some examples, have a different form, such as a sheet metal shelf, a plastic shelf, or any other suitable shelving surface.

As shown in FIG. 8A, the cantilever bracket 154 has a back end portion 162 that narrows towards its forward end, and a comparatively narrower forward portion 164 that, in the illustrated example, has a substantially uniform width along its length. The cantilever bracket 154 can additionally include one or more projections 166 that extend rearwards from the back end portion 162 of the bracket. The example illustrated in FIG. 8A shows a cantilever bracket 154 that has two projections 166 extending from the back end portion 162, but it will be understood that a different number of projections 166, such as one, three, or more than three projections 166 can be included.

The projections 166 can further include one or more notches 168. The notches 168 can be sized such that they can receive an edge or lip of a receiving feature (for example, a corresponding slot 170 in an upright column 108, as described in greater detail herein), and secure the cantilever bracket 154 to a corresponding upright column 108. In some examples, such as that illustrated in FIGS. 8A and 8C, the projections 166 can include two notches 168, but it is to be understood that a different number of notches 168 can be included instead, such as one, three, or more than three notches 168, depending on any of the other features of an example. Furthermore, while FIGS. 8A and 8C show an example cantilever bracket 154 in which the notches 168 are positioned at substantially the same place on both projections 166, it will be understood that, in some examples having more than one projection 166, the projections 166 can include notches 168 that are differently positioned along the length of the projections 166 (that is, one notch 168 on one projection 166 can be further forward or further behind a corresponding notch 168 on a different projection 166, even if both projections 166 each only include a single notch 168).

In some examples, such as that shown in FIGS. 8A and 8C, the projections 166 can be substantially hook shaped or notched, but it will be appreciated that other geometries can be selected for the geometries of the projections 166, depending on how the projections 166 are to be attached to the upright columns 108.

To allow the cantilevered shelves 104 to be attached to the upright columns 108, the upright columns 108 can include one or more features that can be engaged by one or more corresponding features of the cantilever brackets 154. For example, as shown in FIG. 1, the upright columns 108 can further include a series of vertically spaced apart slots 170 on a front-facing side 172 (that is, a side oriented towards the front of the shelving assembly 100). The slots 170 can be sized to receive the projections 166 of the cantilevered brackets. When the projections 166 are inserted into one or more corresponding slots 170, one of notches 168 captures a lip or edge of the corresponding slot 170 and attaches the cantilever bracket 154 to the upright column 108. Because upright columns 108 can include a series of slots 170 that are vertically spaced apart from one another, the positioning of the cantilever brackets 154 (and thus the placement of the cantilevered shelves 104) can be vertically adjusted by selecting a differently positioned slot 170, allowing the cantilevered shelves 104 to be positioned at one of a plurality of selectable positions along the height of the upright columns 108.

In examples having at least two projections 166, where at least one of the notches 168 on one of the projections 166 is further forward or further behind a corresponding notch 168 on a different projection 166, the projections 166 can be inserted into the corresponding slots 170 such that one projection 166 is inserted further into the corresponding slot 170 than another projection 166, to engage a differently positioned notch 168. This causes the cantilever bracket 154 (and accordingly the cantilevered shelf 104) to be connected to the upright column 108 at an angle (as defined for example relative to a level plane perpendicular to the upright columns 108, or by a level plane that is parallel to the floor) that is determined by the difference in the depth of the projections 166.

According to some aspects of the present disclosure, the shelves 104, 174 may be angularly adjustable by selecting between one of several insertion positions of the projections 166 (and thus the notches 168) relative to the slots 170. It will be apparent to one skilled in the art that multiple notches 168 can be provided in each of the projections 166, so that different positions and therefore different angles can be selected. In some examples, the angle between the shelves and a plane defined as perpendicular to the upright columns 108 can range from 0° to 30° above or below parallel, such as 0°, 5°, 10°, 15°, 20°, 25°, or 30° above or below parallel to the plane.

When the cantilever bracket 154 are attached to the upright columns 108 as described herein, the cantilevered shelf 104 is supported by the upright columns 108 at one end (that is, the rear end), but are free at the other end (that is, the front end), and the forward shelf edge 160 of the cantilevered shelf 104 may therefore be uninterrupted by any column or supporting structure across its entire length.

FIGS. 8A-8C show an example cantilevered shelf 104 with a spacing between the cantilever brackets 154 that matches the spacing between an adjacent pair of upright columns 108. In some examples, the spacing between the cantilever brackets 154 of the cantilevered shelf 104 will be approximately 30 inches, to support a shelf approximately 30 inches in width (that is, the dimension defined by the spacing between the brackets 154). In some examples, the spacing between the cantilever brackets 154 can range from 20 to 40 inches, or more particularly from 25 to 35 inches. In some examples, the spacing between the cantilever bracket 154 can range from 27-33 inches, or may be 27, 28, 29, 30, 31, 32, or 33 inches, or any length between these dimensions. It will be understood that the width of the shelves may correspond to any of these spacings.

Figure 9A:
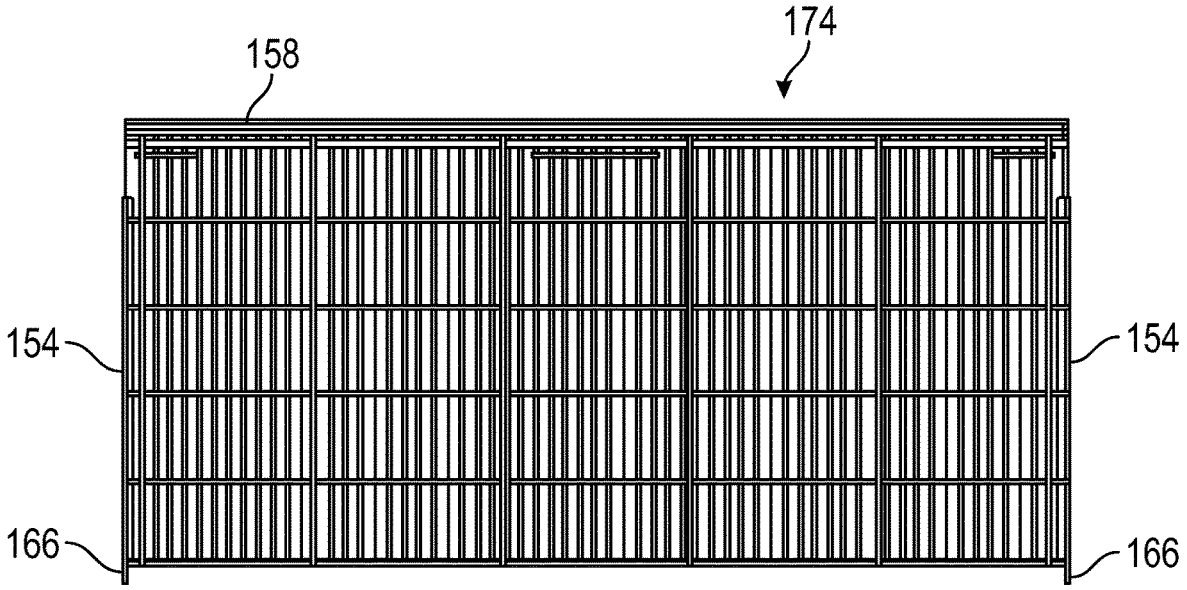
FIG. 9A is a top view of a cantilevered shelving unit according to one aspect of the present disclosure.
Figure 9B:
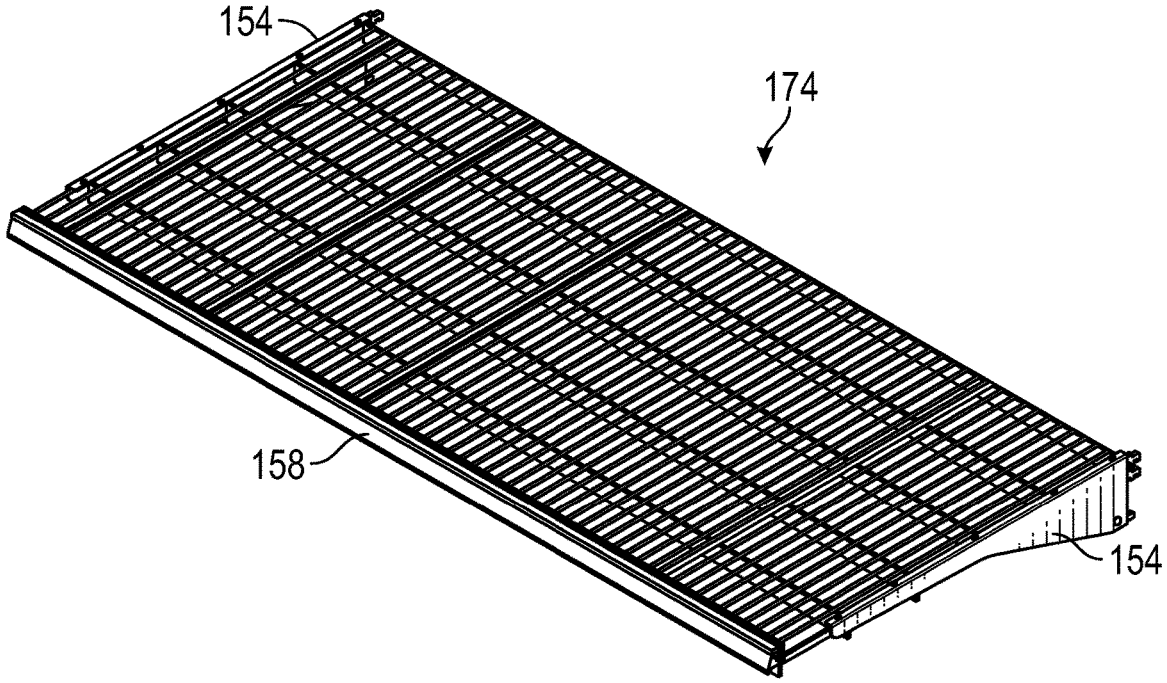
FIG. 9B is a perspective view of the cantilevered shelving unit of FIG. 9A.

FIGS. 9A-9B show a cantilevered shelf 174 according to another aspect of the present disclosure. The cantilevered shelf 174 is substantially similar to the cantilevered shelf 104, apart from the spacing between the cantilever brackets 154. In such examples, the cantilever bracket 154 can be spaced such that they connect to non-adjacent upright columns 108. For example, a first cantilever bracket 154*a* can attach to a first upright column 108*a*, and a second cantilever bracket 154*b* can attach to a second upright column 108*b*, with a third upright column 108*c* disposed between the first upright column 108*a* and the second upright column 108*b* and not attached to any cantilever bracket 154 of the cantilevered shelf 174. In some examples, the spacing between the cantilever bracket 154 of the cantilevered shelf 174 can approximately 60 inches to support a shelf approximately 60 inches in width (that is, the dimension defined by the spacing between the brackets 154). In some examples, the spacing between the cantilever bracket 154 of the cantilevered shelf 174 can range from 50-70 inches, or more particularly from 55-65 inches. In some examples, the spacing between the cantilever bracket 154 of the cantilevered shelf 174 can range from 57-63 inches, or may be 57, 58, 59, 60, 61, 62, or 63 inches, or any length between these dimensions. It will be understood that the width of the shelves may correspond to any of these spacings.

It will be understood that, while FIG. 1 shows a shelving assembly 100 including only a single type of cantilevered shelf, specifically cantilevered shelf 174, it will be appreciated that, in some examples, the shelving assembly 100 can include one or more of each of cantilevered shelves 104, 174.

It will also be understood that correspondingly wider or narrower cantilevered shelves can be provided for example shelving assemblies 100 with a smaller or longer spacing between adjacent upright columns 108, or which have more than 3 upright columns 108 spaced apart along the length of the shelving assembly 100.

Figure 7:
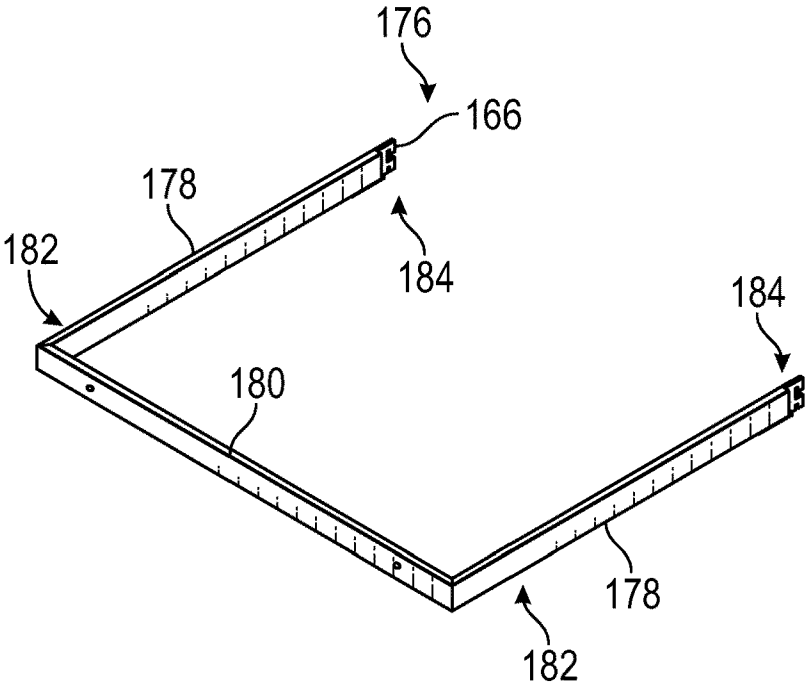
FIG. 7 is a perspective view of a top brace for the shelving assembly of FIG. 1.

According to some aspects of the present disclosure, the shelving assembly 100 can also include an upper brace 176, as illustrated in FIG. 7. The upper brace 176 can include two forwardly extending struts 178 that extend from the top end portion 112 of each of two adjacent upright columns 108 over the base section 106. The upper brace 176 can also include a lateral strut 180 that extends between a forward end portion 182 of each of the forwardly extending struts 178, forming a substantially square upper brace 176, with the forwardly extending struts 178 substantially perpendicular to the cross-support beam 110 and the lateral strut 180 substantially parallel to the cross-support beam 110. In some examples, the forwardly extending struts 178 can include one or more projections 166 substantially similar to those previously described in relation to the cantilever brackets 154, which can extend from a rear end portion 184 of the forwardly extending struts 178, as shown in FIG. 7.

The upper brace 176 can, in such examples, serve to provide additional rigidity to the structure of the shelving assembly 100. Furthermore, when the shelving assembly 100 is place within a cooler or other structure, as described in greater detail herein, the upper brace 176 can provide one or more additional points of contact with the interior of the cooler or other structure, which can stabilize the shelving assembly 100, and prevent rocking, jostling, or tilting of the shelving assembly 100.

According to some aspects of the present disclosure, the cantilevered shelves 104, 174 can be designed to support loads up to a particular limit. For instance, in examples where the shelving assembly 100 includes cantilevered shelves 104, the cantilevered shelves 104 can be designed to support loads of up to 300 pounds, such as maximum loads of 300 pounds, 250 pounds, 200 pounds, 150 pounds, or any maximum load between these numbers. In other examples where the shelving assembly 100 includes cantilevered shelves 174, the cantilevered shelves 174 can be designed to support loads of up to 500 pounds, such as maximum loads of 500 pounds, 450 pounds, 400 pounds, 350 pounds, 300 pounds, or any maximum load between these numbers. It will be appreciated by one of ordinary skill in the art that various maximum loads will be particularly advantageous for different kinds of goods, and further appreciated that the modular nature of the shelving assembly 100 will permit for shelves of different maximum load capacity to be adjustably added or removed to the shelving assembly 100 as needed.

Figure 10:
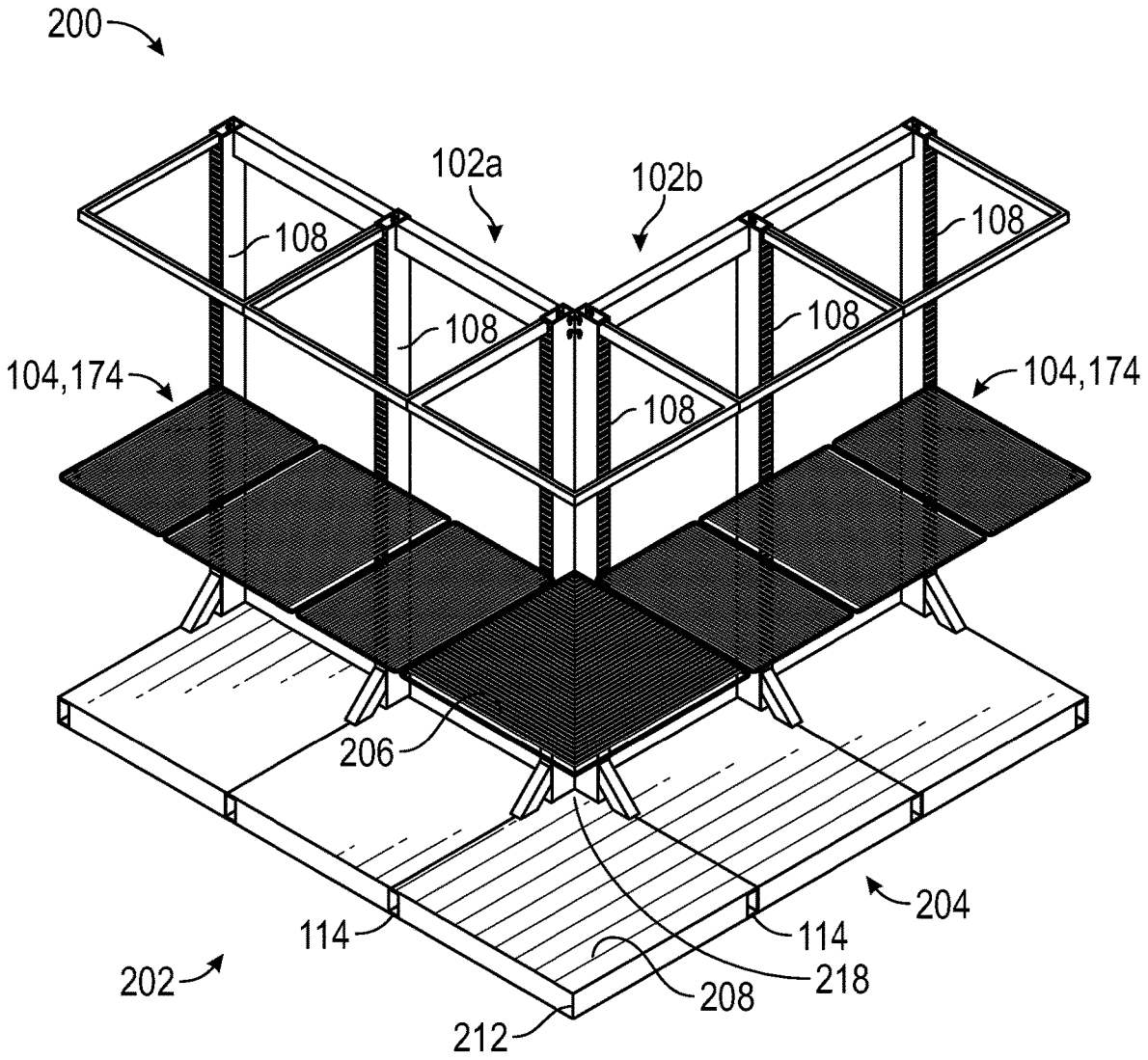
FIG. 10. is a perspective view of a shelving assembly according to another aspect of the present disclosure.

FIG. 10 shows an example shelving assembly 200 according to another aspect of the present disclosure. The shelving assembly 200 is similar or substantially identical to the shelving assembly 100 disclosed herein, except for the differences discussed in greater detail below.

As shown in FIG. 10, the shelving assembly 200 includes at least one frame unit 102*a* positioned substantially perpendicular to a second frame unit 102*b*, such that the shelving assembly 200 includes a first wing 202 and a second wing 204 disposed substantially perpendicularly to each other. Thus, the shelving assembly 200 has an L-shaped or substantially L-shaped footprint, with the upright columns 108 positioned towards the inside of the L-shaped footprint and the cantilevered shelves 104, 174 extending forwards towards the outside of the L-shaped footprint. Accordingly, the shelving assembly 200 can be suitable for use with a cooler or other enclosure that has a substantially L-shaped footprint with doors or other access mechanisms positioned towards the outside of the L-shaped footprint of the enclosure, as discussed in greater detail below.

According to one aspect of the present disclosure, the shelving assembly 200 can include a corner cantilevered shelf 206, as shown in FIG. 10. In contrast to the cantilevered shelves 104, 174 previously described herein, the corner cantilevered shelf 206 is supported by two perpendicular or substantially perpendicular cantilever brackets 154, which converge towards an interior corner 218 of the L-shaped footprint of the shelving assembly 200.

According to one aspect of the present disclosure, the shelving assembly 200 can also include a corner base portion 208. The corner base portion 208 can be formed from two base members 114 extending from adjacent and perpendicular or substantially perpendicular upright columns 108, as shown in FIG. 10, such that the two base members 114 are perpendicular or substantially perpendicular to each other. In some examples, to provide additional structural stability to the corner base portion 208, the two base members 114 can be connected by a pair of corner members (not shown), each corner member extending perpendicularly to a front end portion of the two base members 114, to connect at an exterior corner 212 of the L-shaped footprint of the shelving assembly 200. However, in some examples, the corner members can be omitted.

Figure 11:
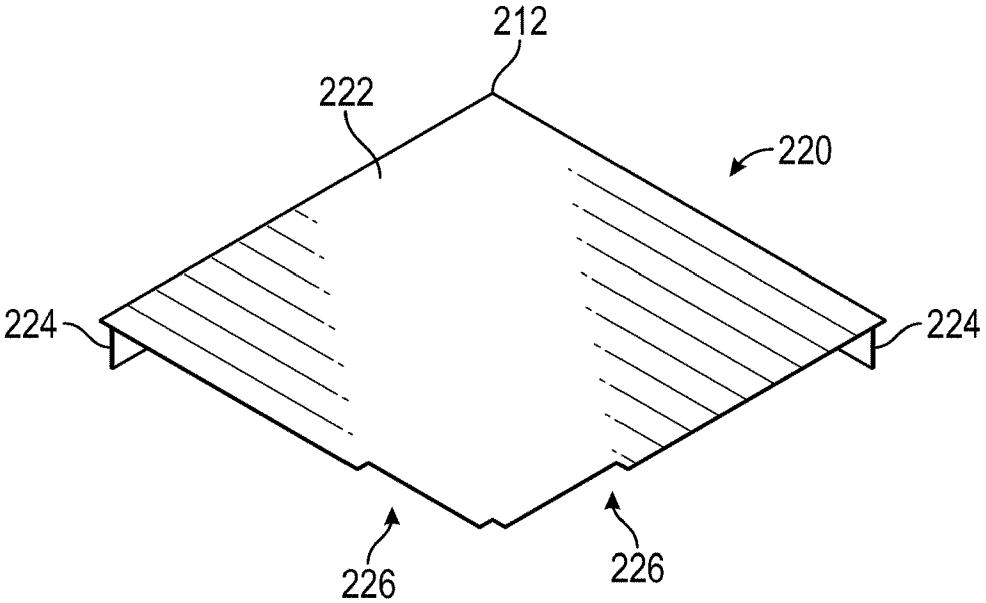
FIG. 11 is a perspective view of a sheet covering for a base section of the shelving assembly of FIG. 10.

The corner base portion 208 can also include a corner base cover 220, which is shown in FIG. 11. The base cover 220 includes a horizontal sheet 222, and a pair of vertical sheets 224 which depend from two adjacent edge portions of the top sheet 222. The corner base cover 220 can also include one or more notches 226 which are sized to accommodate one or more corresponding upright columns 108 of the shelving assembly 200. As shown in FIG. 10, the 208 can be sized such that the corner base cover 220 will fit closely over the base members 114 and the corner members to completely cover the 208, and the portion of the floor beneath the corner base portion 208.

Figure 12:
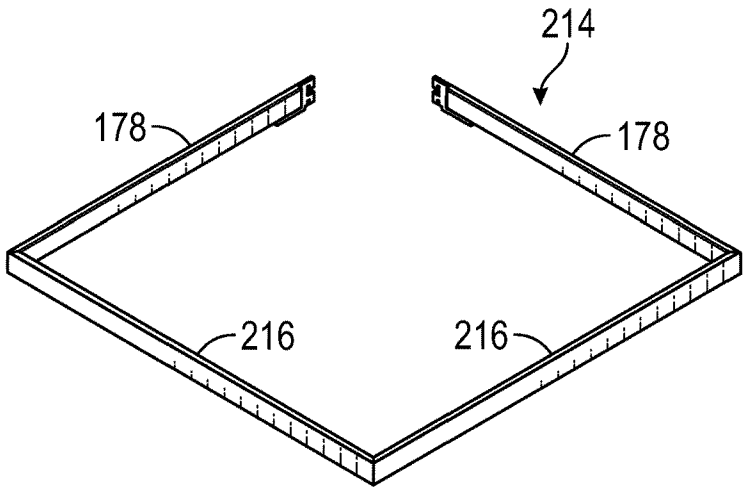
FIG. 12 is a perspective view of a top brace for the shelving assembly of FIG. 10.

According to one aspect of the present disclosure, the shelving assembly 200 can also include a corner brace 214, illustrated in FIG. 12. In contrast to the upper brace 176 described previously, corner brace 214 comprises two forwardly extending struts 178 extending from adjacent and perpendicular upright columns 108, such that the two forwardly extending struts 178 are perpendicular or substantially perpendicular to each other. The corner brace 214 also includes a laterally extending strut 216 extending from the forward end portion 182 of each of the forwardly extending struts 178, such that the laterally extending struts 216 are perpendicular to or substantially perpendicular to each other and connect above the corner base portion 208 of the L-shaped footprint of the shelving assembly 200, as shown in FIG. 10.

Figure 13:
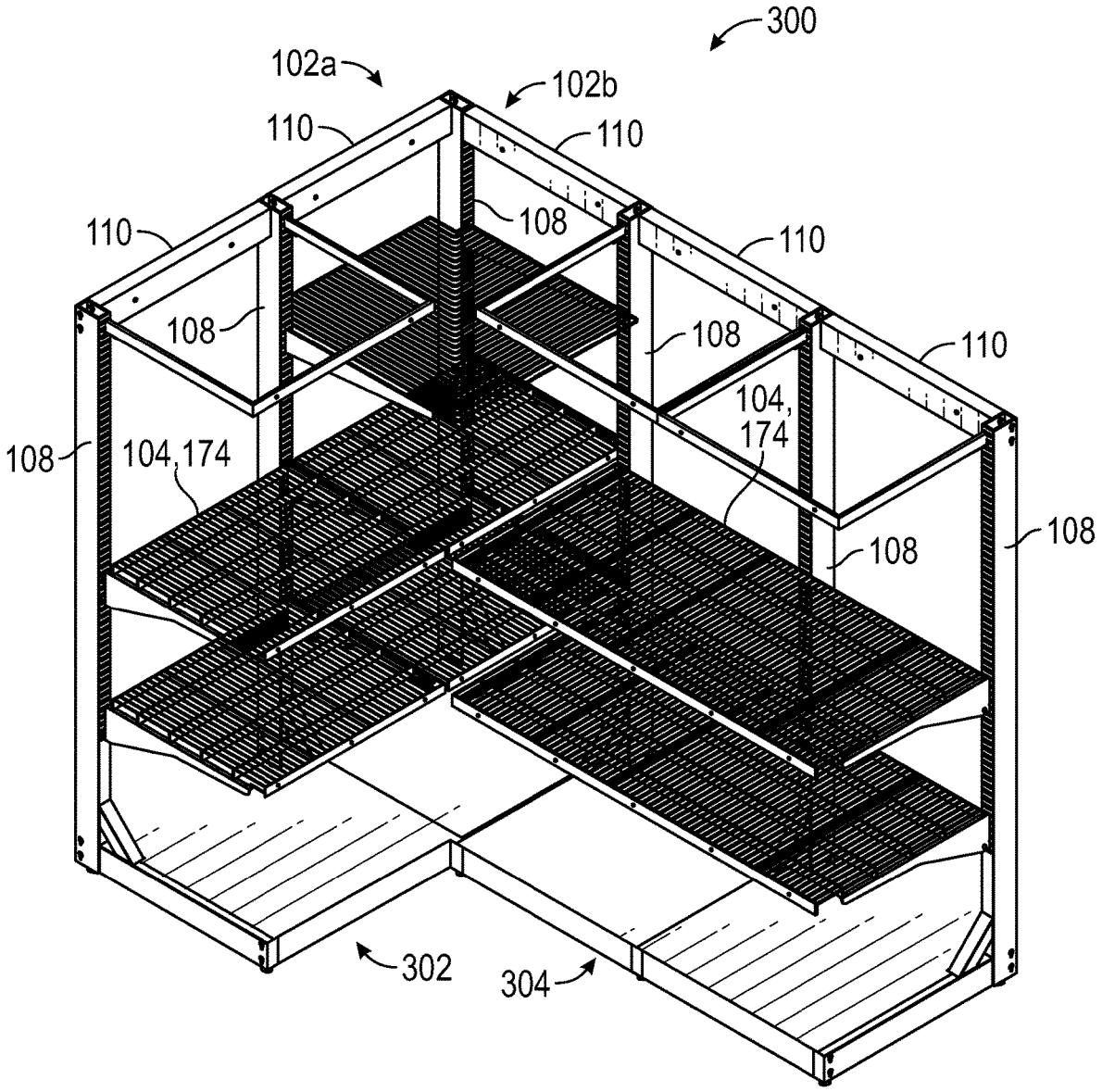
FIG. 13 is a perspective view of a shelving assembly according to another aspect of the present disclosure.

FIG. 13 shows an example shelving assembly 300 according to another aspect of the present disclosure. The shelving assembly 300 is similar or substantially identical to the shelving assembly 200 previously disclosed herein, except for the differences discussed in greater detail below.

As shown in FIG. 13, the shelving assembly 300 includes at least one frame unit 102*a* positioned substantially perpendicular to a second frame unit 102*b*, such that the shelving assembly 300 includes a first wing 302 and a second wing 304 disposed substantially perpendicularly to each other. Thus, the shelving assembly 300 has an L-shaped or substantially L-shaped footprint, with the upright columns 108 positioned towards the outside of the L-shaped footprint and the cantilevered shelves 104, 174 extending forwards towards the inside of the L-shaped footprint. Accordingly, the shelving assembly 300 can, in some examples, be suitable for use with a cooler or other enclosure that has a substantially L-shaped footprint with doors or other access mechanisms positioned towards the inside of the L-shaped footprint of the enclosure, as discussed in greater detail below. In other examples, the shelving assembly 300 can be received in an open-room cooler and/or refrigerated room.

To connect the two frame units 102*a*, 102*b* that form the shelving assembly 300, one or more additional cross-support beams 110 can be positioned between a leftmost upright column 108 of the first frame unit 102*a* and a rightmost upright column 108 of the second frame unit 102*b*, interconnecting the two upright columns 108 in substantially the same manner previously described herein.

The various shelving assemblies 100, 200, 300 disclosed herein, may all be used with a cooler, cabinet, or other containing structure. According to one aspect of the invention, an example cooler 400 is presented in FIG. 14A, comprising a cooler frame 402 with a front portion 404 and a back portion 406. The cooler 400 can enclose a shelving assembly 100, 200, 300 according to any example disclosed herein.

In the illustrated example, the front portion 404 can include one or more doors 408 which permit frontal access to the cooler 400, for example by a customer accessing goods within the cooler 400. The doors 408 can be pivotably mounted to the cooler frame 402 on a corresponding number of hinges 410 disposed on opposite vertical edges of the one or more doors 408 and have a free vertical edge 412 opposite to the hinge 410. Thus, when the one or more doors 408 are closed, a closure seam 414 is formed where the free vertical edges 412 of each of two adjacent one or more doors 408 join, such that the closure seam 414 is positioned between the corresponding hinges 410. When the one or more doors 408 are opened, they will open away from one another, to expose the shelving assembly (for example, the shelving assembly 100 shown in FIG. 14A) to the customer.

Figure 14A:
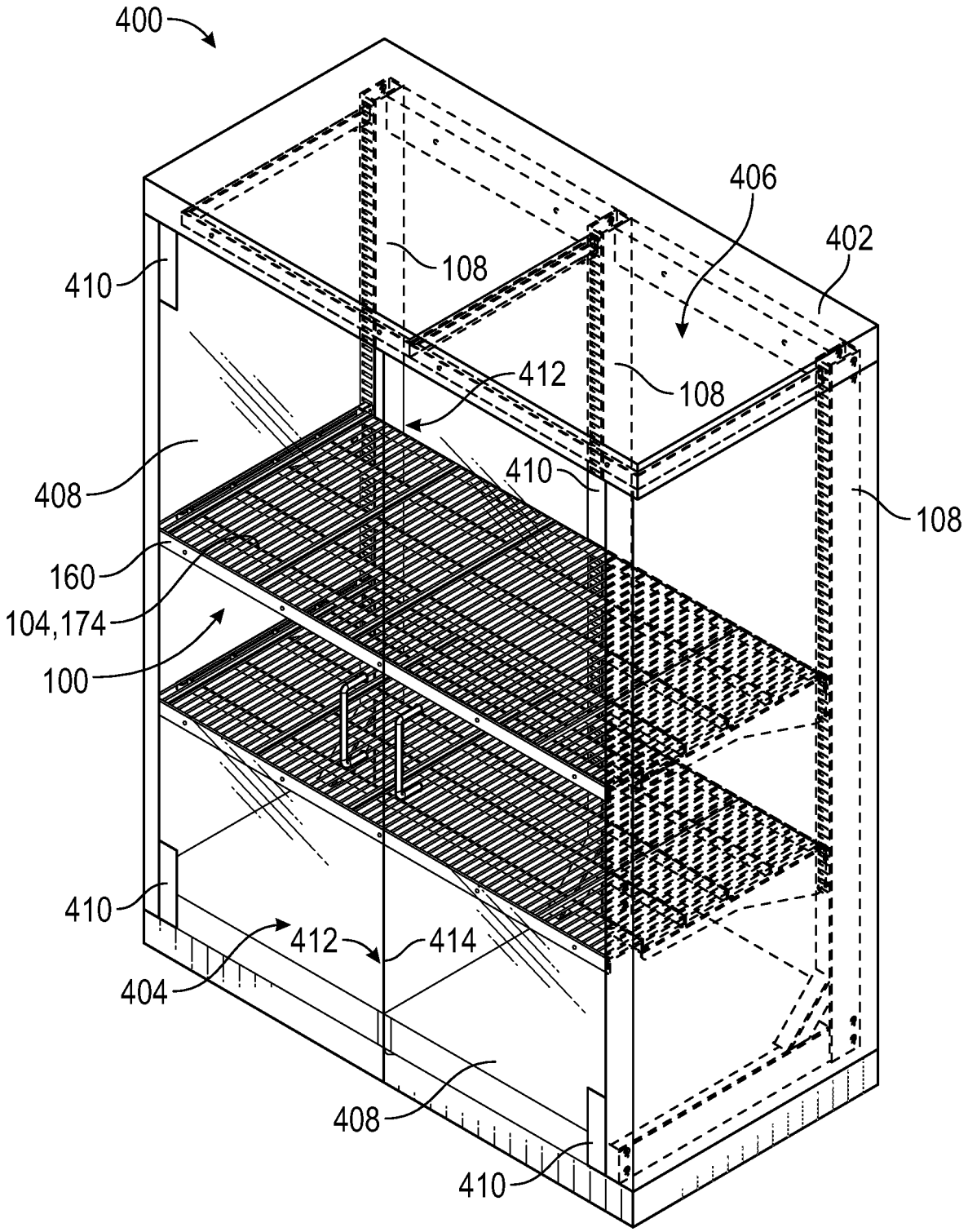
FIG. 14A. is a perspective front view of a goods enclosure according to one aspect of the present disclosure.
Figure 14B:
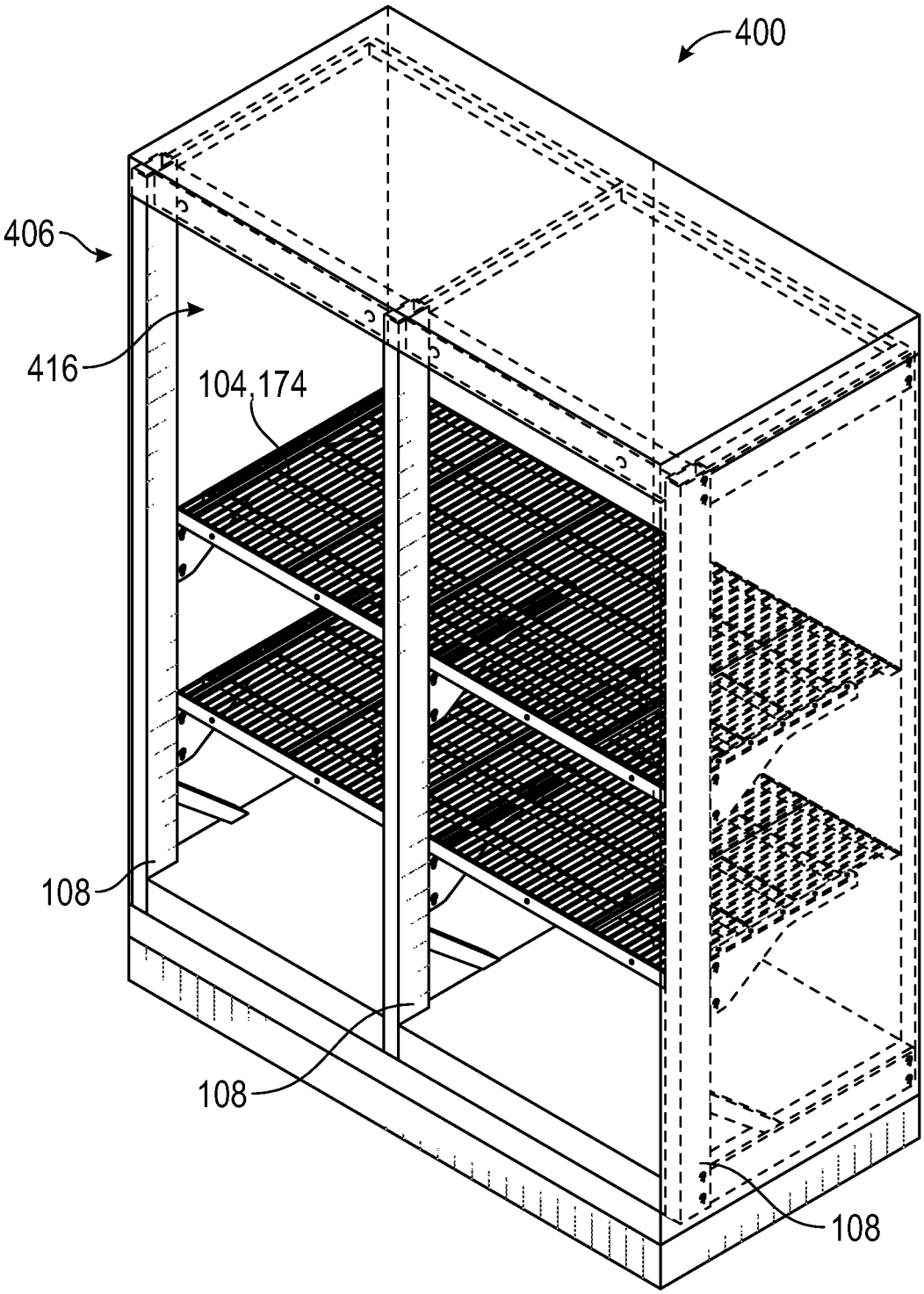
FIG. 14B is a perspective rear view of the goods enclosure of FIG. 14A.

According to one aspect of the present disclosure, the back portion 406 can be open, as illustrated in FIG. 14B, for example to a storeroom or stocking room. Thus, a person may stock the shelving assembly 100 directly from the storeroom through an open span 416 between adjacent upright columns 108, and a person accessing the goods within the cooler 400 (for example, a customer) may have access to stocked goods through the one or more doors 408.

When the shelving assembly 100 is positioned within the cooler 400, the cantilevered shelves 104, 174 extend forward towards the one or more doors 408. In examples of shelving assembly 100 having an upper brace 176, the upper brace 176 can contact an interior surface of the cooler 400, thereby bracing the shelving assembly 100 against the cooler 400 and improving the stability and rigidity of the shelving assembly 100 as previously described.

Because the shelving assembly 100 includes one or more cantilevered shelves 104, 174 connected the upright columns 108 positioned at the rear of the shelving assembly 100, the forward shelf edge 160 of each of the cantilevered shelves 104, 174 will be uninterrupted by any column 108 between the corresponding number of hinges 410, and there will be no upright column 108 blocking or partially blocking a resulting opening between the one or more doors 408, and each forward shelf edge 160 of the cantilevered shelves 104, 174 is continuous extending across the opening between the doors, such that the one or more cantilevered shelves 104, 174 are accessible across the entire width of the opening.

While FIGS. 14A and 14B show a cooler 400 containing a shelving assembly 100 having two frame units 102, it will be appreciated that a longer or shorter cooler 400 could contain a correspondingly longer or shorter shelving assembly 100. It will likewise be appreciated that, in some case, a cooler 400 may have an L-shaped footprint, with the one or more doors 408 positioned towards the exterior of the L-shaped footprint, such that the shelving assembly 100 is stocked from the interior of the L-shaped footprint, and the 400 for use with the shelving assembly 200. Likewise, it will be appreciated that a cooler 400 may have an L-shaped footprint, with the one or more doors 408 positioned towards the interior of the L-shaped footprint, such that the shelving assembly 100 is stocked from the exterior of the L-shaped footprint, and the 400 for use with the shelving assembly 300.

Figure 15:
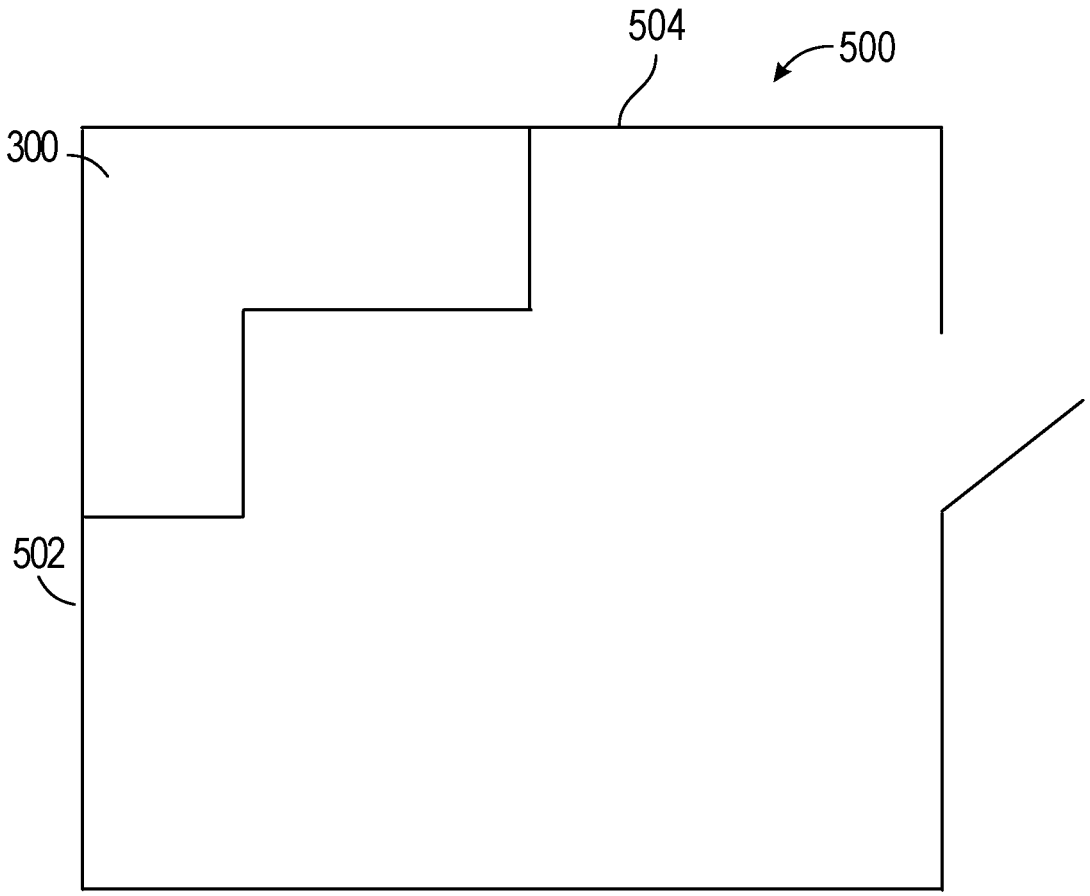
FIG. 15 is a floor plan schematic of an open room containing the shelving assembly of FIG. 13.

According to one aspect of the present disclosure, the cooler and/or refrigerated enclosure can be an open room 500 as illustrated in FIG. 15. The open room 500 can include one or more cantilevered shelving assemblies, particularly shelving assemblies 100 and 300, which can be accessible from the front. In the example illustrated in FIG. 15, a shelving assembly 300 is positioned within the open room 500, such that the shelving assembly 300 abuts a first wall 502 and a second wall 504 (that is, the shelving assembly 300 is positioned in the corner of the open room 500). Thus, the upright columns 108 are positioned immediately adjacent to the first wall 502 and the second wall 504, with the cantilevered shelves 104, 174 extending forwards from the first wall 502 and the second wall 504 towards the center of the open room 500. In such examples, the entire open room 500 can be refrigerated and/or air conditioned to keep the open room 500, any shelving assemblies 100, 300 therein, and any goods stored on the shelving assemblies 100, 300 at a desired temperature.

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments.

ADDITIONAL EXAMPLES OF THE DISCLOSED TECHNOLOGY

This written description uses examples to illustrate the various aspects of the disclosed technology, and to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

Example 1. A shelving assembly, comprising a base having a front and a rear; at least two columns extending upward from the rear of the base; an upper cross-support beam connecting an upper end portion of the two columns; a plurality of cantilevered support brackets, each bracket being attached to a respective one of the columns at one of a plurality of selectable positions along a height of the respective one of the columns, and each bracket extending forward over the base; and at least one shelf supported between two laterally adjacent ones of the support brackets; wherein a span between the two columns is open so that shelf can be loaded from the rear.

Example 2. The shelving assembly of any example herein, particularly example 1, further comprising an upper brace extending from the upper end portion of the at least two columns and forward over the base, the brace comprising at a first forward strut and a second forward strut both extending substantially perpendicular to the upper cross-support beam and forward over the base, and a lateral strut extending substantially parallel to the upper cross-support beam and connecting the front ends of the first struts.

Example 3. The shelving assembly of any example herein, particularly example 1, further comprising one or more additional columns extending upwards from the rear of the base and an additional upper cross-support beam for each of the one or more additional columns, wherein the one or more additional upper cross-support beams connect the upper end portion of each of the one or more additional columns to the upper end portion of an adjacent column.

Example 4. The shelving assembly of any example herein, particularly example 3, further comprising one or more additional cantilevered support brackets attached to a respective one of the additional columns at one of a plurality of selectable positions along a height of the respective one of the additional columns and extending forward over the base.

Example 5. The shelving assembly of any example herein, particularly example 3, wherein the base has an L-shaped footprint, and at least one upper cross-support beam is substantially perpendicular to another upper cross-support beam.

Example 6. The shelving assembly of any example herein, particularly example 5, wherein the at least one shelf extends towards an exterior of the L-shaped footprint and the columns are disposed towards an interior of the L-shaped footprint.

Example 7. The shelving assembly of any example herein, particularly example 6, wherein the base comprises a first wing and a second wing extending from a corner base portion and substantially perpendicular to each other, wherein the at least extend upward from the first wing, at least two additional columns extend upward from the second wing, and a corner column extends upward from the corner base portion, wherein the plurality of cantilevered support brackets supports at least one shelf extending forward from the columns extending upward from the first wing and at least one shelf extending forward from the columns extending upward from the second wing, and wherein the shelving assembly further comprises a first upper brace extending forward from the upper end portion of the at least two columns extending upward from the first wing, and a second brace extending forward from at least two of the columns extending upward from the second wing, each of the first brace and the second brace comprising at pair of forward struts, and a lateral strut extending between the forward struts.

Example 8. The shelving assembly of any example herein, particularly example 5, wherein the at least one shelf extends towards an interior of the L-shaped footprint and the columns are disposed towards an exterior of the L-shaped footprint.

Example 9. The shelving assembly of any example herein, particularly example 8, wherein the base comprises a first wing and a second wing extending from a corner base portion and substantially perpendicular to each other, wherein the at least extend upward from the first wing, at least two additional columns extend upward from the second wing, and a corner column extends upward from the corner base portion, wherein the plurality of cantilevered support brackets supports at least one shelf extending forward from the columns extending upward from the first wing and at least one shelf extending forward from the columns extending upward from the second wing, and wherein the shelving assembly further comprises a first upper brace extending forward from the upper end portion of the at least two columns extending upward from the first wing, and a second brace extending forward from at least two of the columns extending upward from the second wing, each of the first brace and the second brace comprising at pair of forward struts, and a lateral strut extending between the forward struts.

Example 10. The shelving assembly of any example herein, particularly example 1, wherein an angle between a cantilevered support bracket of the plurality of cantilevered support brackets and its respective column is adjustable within 30° of perpendicular to the respective column.

Example 11. The shelving assembly of any example herein, particularly example 1, wherein the at least one shelf comprises a shelf having a width ranging from 27 inches to 33 inches.

Example 12. The shelving assembly of any example herein, particularly example 1, wherein the at least one shelf comprises a shelf having a width ranging from 57 inches to 63 inches.

Example 13. The shelving assembly of any example herein, particularly example 1, wherein the at least one shelf is a plurality of shelves, and wherein the plurality of shelves comprises at least one shelf with a width ranging from 27 inches to 30 inches and at least one shelf with a width ranging from 57 inches to 63 inches.

Example 14. The shelving assembly of any example herein, particularly example 1, wherein the shelf can support a load of at least 500 pounds.

Example 15. The shelving assembly of any example herein, particularly example 1, wherein the base further comprises two or more base struts extending forward from a bottom portion of two or more respective columns, a cross-support beam connecting a forward end portion of each of the two of the two or more base struts, and a removable sheet metal cover disposed over the two or more base struts and the cross-support beam to form a base shelf.

Example 16. The shelving assembly of any example herein, particularly example 1, wherein each column of the at least two columns comprises at least one keyhole slot at the upper end portion of the column, wherein the cross-support beam comprises a number of pegs at each end corresponding to the number of keyhole slots in the upper end portion of each of the columns, and wherein each keyhole slot comprises an aperture and a channel extending from the aperture, each peg comprises a head portion and a shaft portion, and wherein the aperture of each keyhole slot is configured to receive the head portion of a corresponding peg, and the channel is configured to secure the head portion of the corresponding peg.

Example 17. The shelving assembly of any example herein, particularly example 1, wherein the shelf has an edge positioned towards the front of the shelving assembly and extending seamlessly between two adjacent cantilevered brackets.

Example 18. A cooled shelving unit comprising the shelving assembly of any example herein, particularly example 1 enclosed in a refrigerated cooler, wherein the cooler comprises one or more doors located in front of a front portion of the shelving assembly and an access point located behind a rear portion of the shelving assembly and configured to allow access to the rear portion of the shelving assembly so that the shelves can be loaded from the rear.

Example 19. A cooler comprising: a cooler frame having a front portion and a back portion; a pair of doors positioned at the front portion of the cooler frame and having opposite vertical edges pivotally mounted to the cooler frame so that the doors open away from each other and so that free vertical edges of the doors join to form a door closure seam when the doors are closed; and a cantilevered shelving assembly located inside the cooler frame and including a plurality of cantilevered shelves extending forward toward the doors, each shelf having a continuous forward shelf edge extending across the opening between the doors, so that when the doors are open the forward shelf edge of each shelf is accessible across an entire width of the opening; wherein the cooler frame does not include any vertical frame member directly behind the door closure seam, so that when the doors are open there is no vertical frame member blocking an opening between the doors.

Example 20. The cooler of any example herein, particularly example 19, wherein the cantilevered shelving assembly comprises a base, at least two columns extending vertically from the base, an upper cross-support beam extending between the two columns, and an upper brace comprising a first strut and a second strut both extending substantially perpendicular to the upper cross-support beam and towards the front portion of the cooler frame and a third strut extending substantially parallel to the upper cross-support beam and connecting a front end of each of the first strut and the second strut.

Example 21. The cooler of any example herein, particularly example 20, wherein the third strut contacts an interior surface of the upper portion of the cooler frame, such that the cantilevered shelving assembly is braced on the front end by the cooler frame.

Example 22. The cooler of any example herein, particularly example 19, wherein the cantilevered shelves are angularly adjustable relative to a level plane, such that an angle between any of the cantilevered shelves and the level plane can range from 0° to 30°.

Example 23. The cooler of any example herein, particularly example 19, wherein the cooler is a corner cooler, having a first wing and a second wing substantially perpendicular to the first wing to provide a substantially L-shaped footprint, and wherein the cantilevered shelving assembly comprises at least one shelf positioned within each of the first wing and the second wing of the cooler, such that at least one shelf is substantially perpendicular to another shelf.

Example 24. The cooler of any example herein, particularly example 23, wherein the front portion of the cooler is positioned at an exterior of the L-shaped footprint and the back portion of the cooler is positioned at an interior of the L-shaped footprint.

Example 25. The cooler of any example herein, particularly example 23, wherein the back portion of the cooler is positioned at an exterior of the L-shaped footprint and the front portion of the cooler is positioned at an interior of the L-shaped footprint.

Example 26. A shelving unit, comprising: a plurality of vertically extending columns spaced laterally apart from one another, each column of the plurality of vertically extending columns having a top end portion and a bottom end portion; an upper lateral support beam extending between the respective top end portions of two adjacent columns; a lower lateral support beam between the respective bottom end portions of two adjacent columns; a base extending forward from the bottom end portions of each column of the plurality of vertically extending columns and having a front end portion and a back end portion, wherein the front end portion of the base is not attached to any vertically extending column; a plurality of shelving brackets, each shelving bracket of the plurality of shelving brackets removably attached no more than one corresponding column of the plurality of columns; and one or more wire shelves extending between and supported by one or more corresponding pairs of adjacent brackets, wherein the one or more wire shelves are vertically adjustable by adjusting a position of a corresponding pair of adjacent brackets, wherein the vertically extending columns are separated by an open span that allows the one or more wire shelves to be loaded by introducing goods through the open span between the vertically extending columns.

In view of the many possible aspects to which the principles of the disclosure can be applied, it should be recognized that the illustrated aspects are only preferred examples of the disclosure and should not be taken as limiting the scope of the disclosure. Rather, the scope of the disclosure is defined by the following claims. We therefore claim as our disclosure all that comes within the scope these claims.

What is claimed is:

1. A shelving assembly, comprising:

a base having a front and a rear;

at least two columns extending upward from the rear of the base;

an upper cross-support beam connecting an upper end portion of the two columns;

a plurality of cantilevered support brackets, each bracket being attached to a respective one of the columns at one of a plurality of selectable positions along a height of the respective one of the columns, and each bracket extending forward over the base; and at least one shelf supported between two laterally adjacent ones of the support brackets;

wherein a span between the two columns is open so that shelf can be loaded from the rear, wherein the shelving assembly further comprises one or more additional columns extending upwards from the rear of the base and an additional upper cross-support beam for each of the one or more additional columns, wherein the one or more additional upper cross-support beams connect the upper end portion of each of the one or more additional columns to the upper end portion of an adjacent column, wherein the base has an L-shaped footprint, and at least one upper cross-support beam is substantially perpendicular to another upper cross-support beam, wherein the at least one shelf extends towards an exterior of the L-shaped footprint and the columns are disposed towards an interior of the L-shaped footprint, wherein the base comprises a first wing and a second wing extending from a corner base portion and substantially perpendicular to each other, wherein the at least two columns extend upward from the first wing, at least two additional columns extend upward from the second wing, and a corner column extends upward from the corner base portion, wherein the plurality of cantilevered support brackets supports at least one shelf extending forward from the columns extending upward from the first wing and at least one shelf extending forward from the columns extending upward from the second wing, and wherein the shelving assembly further comprises a first upper brace extending forward from the upper end portion of the at least two columns extending upward from the first wing, and a second brace extending forward from at least two of the columns extending upward from the second wing, each of the first brace and the second brace comprising at pair of forward struts, and a lateral strut extending between the forward struts.

2. The shelving assembly of claim 1, wherein:

the base further comprises two or more base struts extending forward from a bottom portion of two or more respective columns, a cross-support beam connecting a forward end portion of each of the two of the two or more base struts, and a removable sheet metal cover disposed over the two or more base struts and the cross-support beam to form a base shelf.

3. The shelving assembly of claim 1, wherein an angle between a cantilevered support bracket of the plurality of cantilevered support brackets and its respective column is adjustable within 30° of perpendicular to the respective column.

4. The shelving assembly of claim 1, wherein the at least one shelf comprises a shelf having a width ranging from 27 inches to 33 inches.

5. The shelving assembly of claim 1, wherein the at least one shelf comprises a shelf having a width ranging from 57 inches to 63 inches.

6. The shelving assembly of claim 1, wherein the at least one shelf is a plurality of shelves, and wherein the plurality of shelves comprises at least one shelf with a width ranging from 27 inches to 30 inches and at least one shelf with a width ranging from 57 inches to 63 inches.

7. The shelving assembly of claim 1, wherein the shelf can support a load of at least 500 pounds.

8. The shelving assembly of claim 1, wherein each column of the at least two columns comprises at least one keyhole slot at the upper end portion of the column, wherein the cross-support beam comprises a number of pegs at each end corresponding to the number of keyhole slots in the upper end portion of each of the columns, and wherein each keyhole slot comprises an aperture and a channel extending from the aperture, each peg comprises a head portion and a shaft portion, and wherein the aperture of each keyhole slot is configured to receive the head portion of a corresponding peg, and the channel is configured to secure the head portion of the corresponding peg.

9. The shelving assembly of claim 1, wherein the shelf has an edge positioned towards the front of the shelving assembly and extending seamlessly between two adjacent cantilevered brackets.

10. A cooled shelving unit comprising the shelving assembly of claim 1 enclosed in a refrigerated cooler, wherein the cooler comprises one or more doors located in front of a front portion of the shelving assembly and an access point located behind a rear portion of the shelving assembly and configured to allow access to the rear portion of the shelving assembly so that the shelves can be loaded from the rear.

11. A shelving assembly, comprising:

a base having a front and a rear;

at least two columns extending upward from the rear of the base;

an upper cross-support beam connecting an upper end portion of the two columns;

a plurality of cantilevered support brackets, each bracket being attached to a respective one of the columns at one of a plurality of selectable positions along a height of the respective one of the columns, and each bracket extending forward over the base; and at least one shelf supported between two laterally adjacent ones of the support brackets;

wherein a span between the two columns is open so that shelf can be loaded from the rear, wherein the shelving assembly further comprises one or more additional columns extending upwards from the rear of the base and an additional upper cross-support beam for each of the one or more additional columns, wherein the one or more additional upper cross-support beams connect the upper end portion of each of the one or more additional columns to the upper end portion of an adjacent column, wherein the base has an L-shaped footprint, and at least one upper cross-support beam is substantially perpendicular to another upper cross-support beam, wherein the at least one shelf extends towards an interior of the L-shaped footprint and the columns are disposed towards an exterior of the L-shaped footprint wherein the base comprises a first wing and a second wing extending from a corner base portion and substantially perpendicular to each other, wherein the at least two columns extend upward from the first wing, at least two additional columns extend upward from the second wing, and a corner column extends upward from the corner base portion, wherein the plurality of cantilevered support brackets supports at least one shelf extending forward from the columns extending upward from the first wing and at least one shelf extending forward from the columns extending upward from the second wing, and wherein the shelving assembly further comprises a first upper brace extending forward from the upper end portion of the at least two columns extending upward from the first wing, and a second brace extending forward from at least two of the columns extending upward from the second wing, each of the first brace and the second brace comprising at pair of forward struts, and a lateral strut extending between the forward struts.

12. The shelving assembly of claim 11, wherein an angle between a cantilevered support bracket of the plurality of cantilevered support brackets and its respective column is adjustable within 30° of perpendicular to the respective column.

13. The shelving assembly of claim 11, wherein the at least one shelf comprises a shelf having a width ranging from 27 inches to 33 inches.

14. The shelving assembly of claim 11, wherein the at least one shelf comprises a shelf having a width ranging from 57 inches to 63 inches.

15. The shelving assembly of claim 11, wherein the at least one shelf is a plurality of shelves, and wherein the plurality of shelves comprises at least one shelf with a width ranging from 27 inches to 30 inches and at least one shelf with a width ranging from 57 inches to 63 inches.

16. The shelving assembly of claim 11, wherein the shelf can support a load of at least 500 pounds.

17. The shelving assembly of claim 11, wherein the base further comprises two or more base struts extending forward from a bottom portion of two or more respective columns, a cross-support beam connecting a forward end portion of each of the two of the two or more base struts, and a removable sheet metal cover disposed over the two or more base struts and the cross-support beam to form a base shelf.

18. The shelving assembly of claim 11, wherein each column of the at least two columns comprises at least one keyhole slot at the upper end portion of the column, wherein the cross-support beam comprises a number of pegs at each end corresponding to the number of keyhole slots in the upper end portion of each of the columns, and wherein each keyhole slot comprises an aperture and a channel extending from the aperture, each peg comprises a head portion and a shaft portion, and wherein the aperture of each keyhole slot is configured to receive the head portion of a corresponding peg, and the channel is configured to secure the head portion of the corresponding peg.

19. The shelving assembly of claim 11, wherein the shelf has an edge positioned towards the front of the shelving assembly and extending seamlessly between two adjacent cantilevered brackets.

20. A cooled shelving unit comprising the shelving assembly of claim 11 enclosed in a refrigerated cooler, wherein the cooler comprises one or more doors located in front of a front portion of the shelving assembly and an access point located behind a rear portion of the shelving assembly and configured to allow access to the rear portion of the shelving assembly so that the shelves can be loaded from the rear.

* * * * *